US005888135A

United States Patent [19]

Barton, Jr. et al.

[11] Patent Number: 5,888,135

[45] Date of Patent: Mar. 30, 1999

[54] SYSTEM FOR, AND METHOD OF, SELECTIVELY PROVIDING THE OPERATION OF TOY VEHICLES

[75] Inventors: William M. Barton, Jr., Encinitas; Peter C. DeAngelis, Carlsbad; Paul Eichen, Rancho Santa Fe, all of Calif.

[73] Assignee: Rokenbok Toy Company, Cardiff, Calif.

[21] Appl. No.: 763,678

[22] Filed: Dec. 11, 1996

[51] Int. Cl.[6] ..... A63H 17/39

[52] U.S. Cl. ..... 463/39; 463/62; 446/454; 446/456

[58] Field of Search ..... 463/40, 62, 63, 463/6; 446/454, 456, 457, 470, 465, 431, 436, 441

[56] References Cited

U.S. PATENT DOCUMENTS

| | | | |
|---|---|---|---|
| 3,705,387 | 12/1972 | Stern et al. | 446/460 |
| 3,722,135 | 3/1973 | Jacobson | 446/454 |
| 4,247,107 | 1/1981 | Smith, III et al. | 463/62 |
| 4,406,085 | 9/1983 | Rhodes | 446/456 |
| 4,654,659 | 3/1987 | Kubo | 446/454 |
| 4,938,483 | 7/1990 | Yavetz | 446/456 |

FOREIGN PATENT DOCUMENTS

| | | |
|---|---|---|
| 0227614 | 9/1985 | Germany . |
| 4219780 | 12/1993 | Germany . |
| 2285225 | 12/1993 | United Kingdom . |

*Primary Examiner*—Jessica J. Harrison
*Attorney, Agent, or Firm*—Ellsworth R. Roston; Fulwilder Patton Lee & Utecht, LLP

[57] ABSTRACT

A key in a vehicle socket closes contacts to reset a vehicle microcontroller to a neutral state. Ribs disposed in a particular pattern in the key operate switches in a particular pattern in the vehicle to provide an address for the vehicle with the vehicle inactive but powered. When the vehicle receives such individual address from a pad within a first particular time period thereafter, the vehicle is operated by commands from the pad. The pad operates the vehicle as long as the vehicle receives commands from the pad within the first particular period after the previous command from the pad. During this period, the vehicle has a first illumination to indicate that it is being operated. When the pad fails to provide commands to the vehicle within such first particular time period, the vehicle becomes inactive but powered and provides a second illumination. While inactive but powered, the vehicle can be addressed and subsequently commanded by any of the pads including the pad previously addressing the vehicle. The vehicle becomes de-activated and not illuminated if (a) the vehicle is not selected by any of the pads during a second particular time period after becoming inactivated but powered or, alternatively, (b) all of the vehicles become inactivated but powered and none is selected during the second particular period. The key can thereafter be actuated again to operate the vehicle to the inactive but powered state.

87 Claims, 10 Drawing Sheets

VCC
POWER UP RESET
122
VCC
130
12
TIME BASE FOR MICROCONTROLLER
XTAL
MICRO CONTROLLER
RAM
ROM
126
124
VEHICLE ADDRESS SELECT
128
130
132
4
TRANSISTOR DRIVER
120
MOTOR 1
28
MOTOR 2
30
MOTOR 3
32
MOTOR 4
33
POWER ON
69
RF POWER MANAGEMENT
RF RECEIVER
121
BATTERY
VCC
4.5V
GND

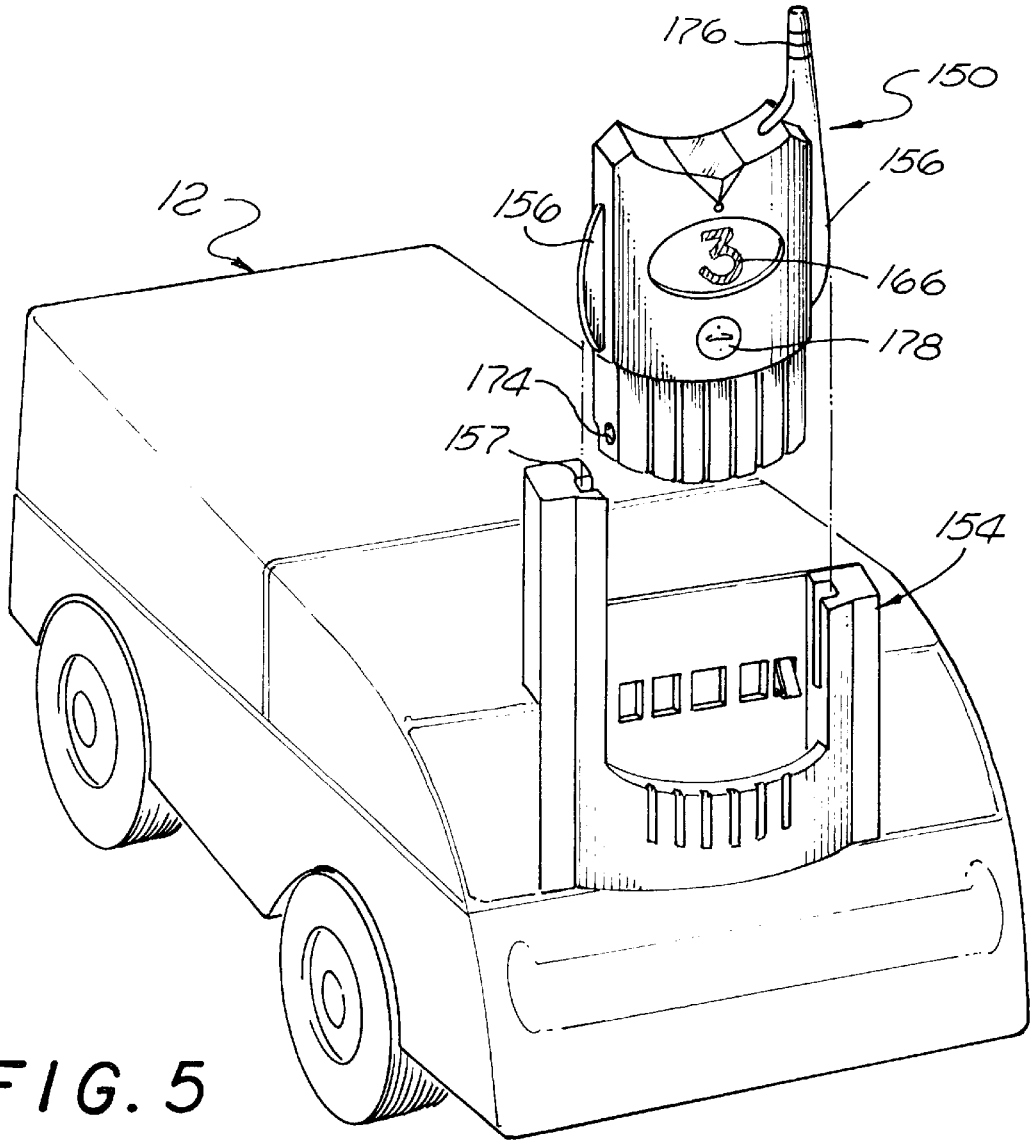
FIG. 5
FIG. 6
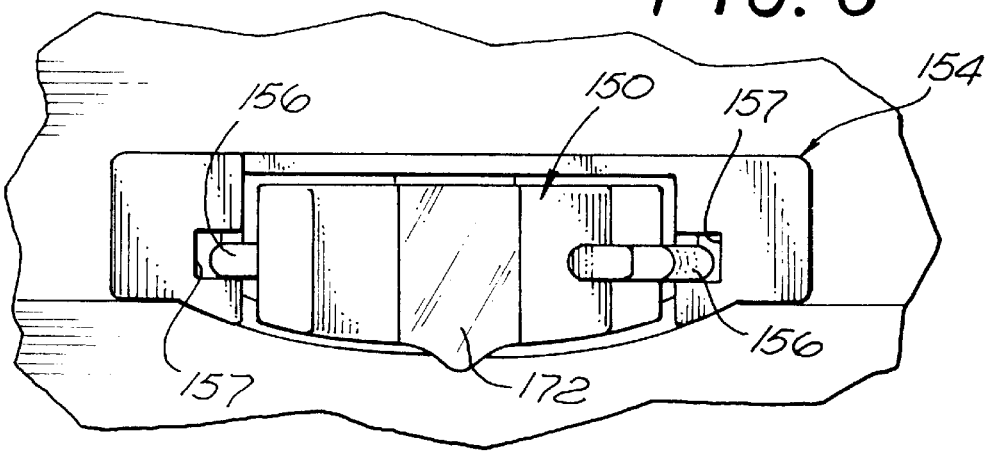

SYSTEM FOR, AND METHOD OF, SELECTIVELY PROVIDING THE OPERATION OF TOY VEHICLES

This invention relates to a system for pleasurable use by people of all ages with youthful minds in operating remotely controlled vehicles simultaneously in a somewhat confined area. In the system of this invention, the vehicles can be remotely controlled to perform competitive or co-operative tasks. The system of this invention includes pads for operation by the users, vehicles remotely controlled in accordance with the operation of the pads and a central station for co-ordinating the operation of the pads and the vehicles. The invention additionally relates to methods of controlling the operation of the vehicles on a remotely controlled basis.

BACKGROUND OF THE INVENTION

Various types of play systems exist, and have existed for some time, in which vehicles are moved on a remotely controlled basis. However, such systems generally provide one hand-held unit and one remotely controlled vehicle for operation by the hand-held unit. Examples of a vehicle in such a system are an automobile or an airplane. Furthermore, the functions of the remotely controlled unit, other than movement along a floor or along the ground or in the air, are quite limited.

Other types of play systems involve the use of blocks for building structures. These blocks often include structure for providing an interlocking relationship between abutting blocks. In this way, elaborate structures can be created by users with creative minds.

Tests have indicated that there is a desirability, and even a need, for play systems in which vehicles are remotely operated to perform functions other than to move aimlessly along a floor or along the ground. For example, tests have indicated that there is a desirability, and even a need, for a play system in which the remotely controlled vehicles can transport elements such as blocks to construct creative structures. There is also a desirability, and even a need, for play systems in which a plurality of vehicles can be remotely controlled by switches in hand-held pads to compete against one another in performing a first task or to co-operate in performing a second task. Such a desirability, or even a need, has existed for a long period of time, probably decades, without a satisfactory resolution.

Co-pending application Ser. No. 08/580,753 filed by John J. Crane on Dec. 29, 1995, for a "Remote Control System for Operating Toys" and assigned of record to the assignee of record of this application discloses and claims a play system for use by people of all ages with youthful minds. It provides for a simultaneous control by each player of an individual one of a plurality of remotely controlled vehicles. This control is provided by the operation by each such player of switches in a hand-held unit or pad, the operation of each switch in such hand-held unit providing a control of a different function in the individual one of the remotely controlled vehicles. Each of the remotely controlled vehicles in the system disclosed and claimed in application Ser. No. 08/580,753 can be operated in a competitive relationship with others of the remotely controlled vehicles or in a co-operative relationship with others of the remotely controlled vehicles. The vehicles can be constructed to pick up and transport elements such as blocks or marbles and to deposit such elements at displaced positions.

When manually closed in one embodiment of the system disclosed and claimed in application Ser. No. 08/580,753, switches in pads control the selection of toy vehicles and the operation of motors for moving the vehicles forwardly, rearwardly, to the left and to the right and moving upwardly and downwardly (and rightwardly and leftwardly) a receptacle for holding transportable elements (e.g. marbles) or blocks.

When sequentially and cyclically interrogated by a central station, each pad in the system disclosed and claimed in application Ser. No. 08/580,753 sends through wires to the central station signals indicating the switch closures in such pad. Such station produces first binary signals addressing the vehicle selected by such pad and second binary signals identifying the motor control operations in such vehicle. Thereafter the switches identifying in such pad the motor control operations in such selected vehicle can be closed without closing the switches identifying such vehicle.

The first and second signals for each vehicle in the system disclosed and claimed in application Ser. No. 08/580,753 are transmitted by wireless by the central station to all of the vehicles at a common carrier frequency modulated by the first and second binary signals. The vehicle identified by the transmitted address demodulates the modulating signals and operates its motors in accordance with such demodulation. When the station fails to receive signals from a pad for a particular period of time, the vehicle selected by such pad becomes available for selection by another pad and such pad can select that vehicle or another vehicle.

A cable may couple two (2) central stations (one as a master and the other as a slave) in the system disclosed and claimed in application Ser. No. 08/580,753 so as to increase the number of pads controlling the vehicles. Stationary accessories (e.g. elevator) connected by wires to the central station become operative when selected by the pads.

BRIEF DESCRIPTION OF THE INVENTION

In one embodiment of the invention, a key in a vehicle socket closes contacts to reset a microcontroller in the vehicle to a neutral state. Ribs disposed in a particular pattern in the key operate switches in a particular pattern in the vehicle to provide an address for the vehicle with the vehicle inactive but powered.

When the vehicle receives such individual address from an individual one of the pads in a plurality within a first particular time period thereafter, the vehicle is operated by commands from such pad. Such individual pad operates such vehicle as long as such vehicle receives commands from such individual pad within the first particular period after the previous command from such individual pad. During this period, the vehicle has a first illumination to indicate that it is being operated.

When the individual pad fails to provide commands to such vehicle within such first particular time period, the vehicle becomes inactive but powered and provides a second illumination. While inactive but powered, the vehicle can be addressed and subsequently commanded by any pad including the individual pad, which thereafter commands the vehicle. The vehicle becomes de-activated and not illuminated if (a) the vehicle is not selected by any of the pads during a second particular time period after becoming inactivated but powered or, alternatively, (b) all of the vehicles become inactivated but powered and none is selected during the second particular period. The key can thereafter be actuated to operate the vehicle to the inactive but powered state.

BRIEF DESCRIPTION OF THE DRAWINGS

In the drawings:

FIG. 5 is an exploded perspective view of a vehicle and a key which is insertable into a socket in the vehicle to provide an individual address for the vehicle;

FIG. 6 is a top plan view of the vehicle and the key with the key inserted into the vehicle;

DETAILED DESCRIPTION OF THE INVENTION

Figure 1:
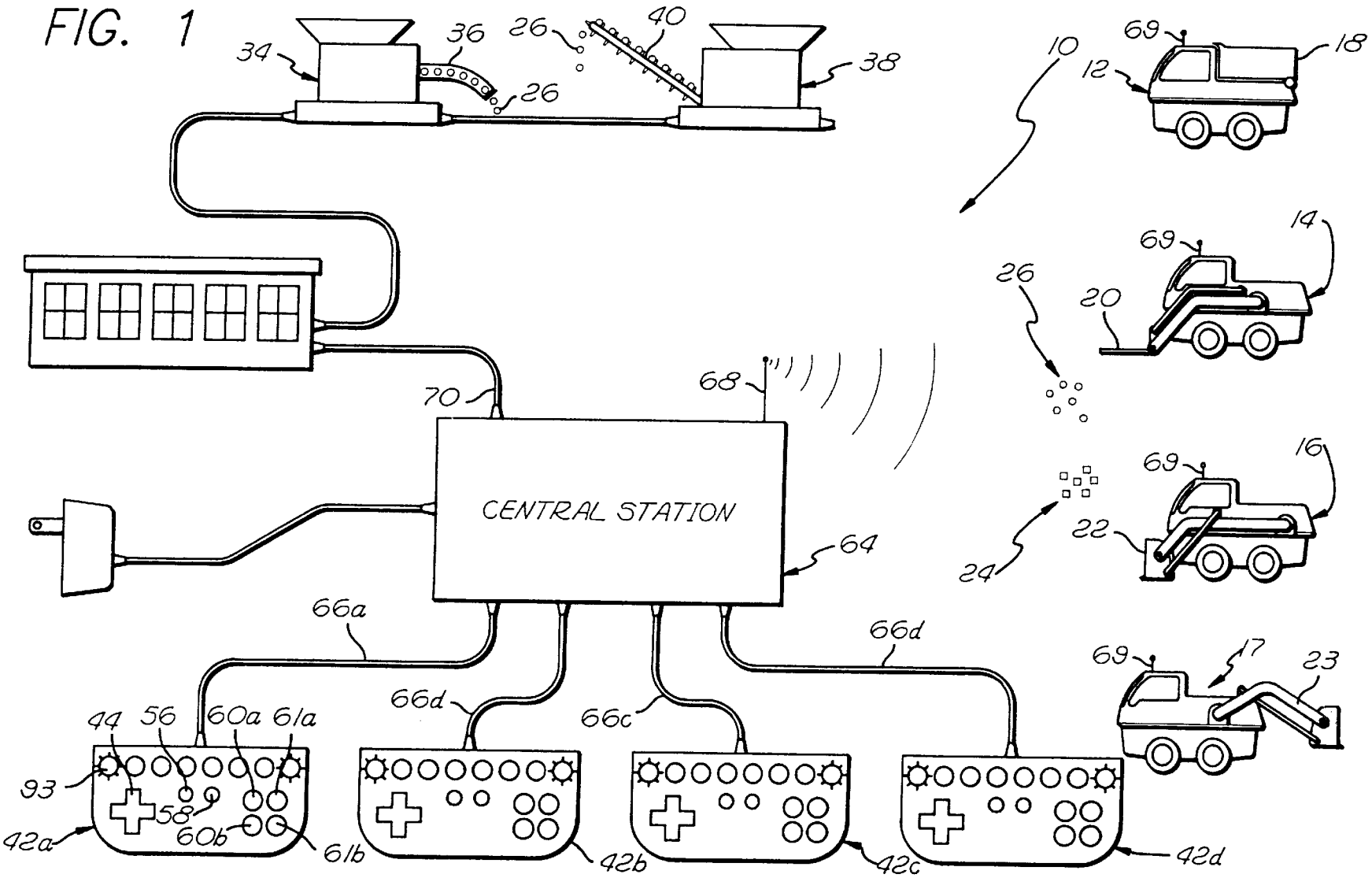
FIG. 1 is a schematic diagram, primarily in block form, of a system constituting one embodiment of the invention.

In one embodiment of the invention, a system generally indicated at 10 in FIG. 1 is provided for controlling the selection and operation of a plurality of toy vehicles. Illustrative examples of toy vehicles constitute a dump truck generally indicated at 12, a fork lift generally indicated at 14, a skip loader generally indicated at 16 and another form of skip loader generally indicated at 17. The toy vehicles such as the dump truck 12, the fork lift 14 and the skip loaders 16 and 17 are simplified versions of commercial units performing functions similar to those performed by the toy vehicles 12, 14, 16 and 17. For example, the dump truck 12 may include a working or transport member such as a pivotable bin or container 18; the fork lift 14 may include a working or transport member such as a pivotable platform 20; the skip loader 16 may include a working or transport member such as a pivotable bin or container 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

Each of the dump truck 12, the fork lift 14 and the skip loaders 16 and 17 may include a plurality of motors. For example, the dump truck 12 may include a pair of reversible motors 28 and 30 (FIG. 4) operable to move the dump truck forwardly, rearwardly, to the right and to the left. The motor 28 controls the movement of the front and rear left wheels and the motor 30 controls the movement of the front and rear right wheels.

When the motors 28 and 30 are simultaneously operated in one direction, the dump truck 12 moves forwardly. The vehicle 12 moves rearwardly when the motors 28 and 30 are operated in the opposite direction. The vehicle 12 turns toward the left when the motor 30 is operated without simultaneous operation of the motor 28. The vehicle 12 turns toward the right when the motor 28 is operated without a simultaneous operation of the motor 30.

The vehicle 12 spins to the left when the motor 30 operates to move the vehicle forwardly at the same time that the motor 28 operates to move the vehicle rearwardly. The vehicle 12 spins to the right when the motors 28 and 30 are operated in directions opposite to the operations of the motors in spinning the vehicle to the left.

Another reversible motor 32 in the dump truck 12 operates in one direction to pivot the bin 18 upwardly and in the other direction to pivot the bin downwardly. An additional motor 33 may operate in one direction to turn the bin 18 to the left and in the other direction to turn the bin to the right.

The construction of the motors 28, 30, 32 and 33 and the disposition of the motors in the dump truck to operate the dump truck are considered to be well known in the art. The fork lift 14 and the skip loaders 16 and 17 may include motors corresponding to those described above for the dump truck 12.

The system 10 may also include stationary plants or accessories. For example, the system 10 may include a pumping station generally indicated at 34 (FIG. 1) for pumping elements such as the marbles 26 through a conduit 36. The system may also include a conveyor generally indicated at 38 for moving the elements such as the marbles 26 upwardly on a ramp 40. When the marbles reach the top of the ramp 40, the elements such as the marbles 26 may fall into the bin 18 in the dump truck 12 or into the bin 22 in the skip loader 16. For the purposes of this application, the construction of the pumping station 34 and the conveyor 38 may be considered to be within the purview of a person of ordinary skill in the art.

The system 10 may also include a plurality of hand-held pads generally indicated at 42*a*, 42*b*, 42*c* and 42*d* (FIG. 1). Each of the pads 42*a*, 42*b*, 42*c* and 42*d* may have a substantially identical construction. Each of the pads may include a plurality of actuatable buttons. For example, each of the pads may include a 4-way button 44 in the shape of a cross. Each of the different segments in the button 44 is connected to an individual one of a plurality of switches 46, 48, 50 and 52 in FIG. 2.

When the button 44 is depressed at the segment at the top of the button, the switch 46 is closed to obtain the operation of the motors 28 and 30 (FIG. 4) in moving the selected one of the vehicle 12 forwardly. Similarly, when the segment at the bottom of the button 44 is depressed, the switch 48 is closed to obtain the operation of the motors 28 and 30 (FIG. 4) in moving the vehicle 12 rearwardly. The selective depression of the right and left segments of the button 44 cause the motors 28 and 30 to operate in spinning the vehicle in individual ones of the two (2) opposite directions.

It will be appreciated that pairs of segments of the button 44 may be simultaneously depressed. For example, the top and left portions of the button 44 may be simultaneously depressed to obtain a simultaneous movement of the vehicle 12 forwardly and to the left. This is in accordance with the operation of a microcontroller which will be described in detail subsequently. However, a simultaneous actuation of the top and bottom segments of the button 44 will not have any effect since they represent contradictory commands. This is also true of a simultaneous depression of the left and right segments of the button 44.

Figure 2:
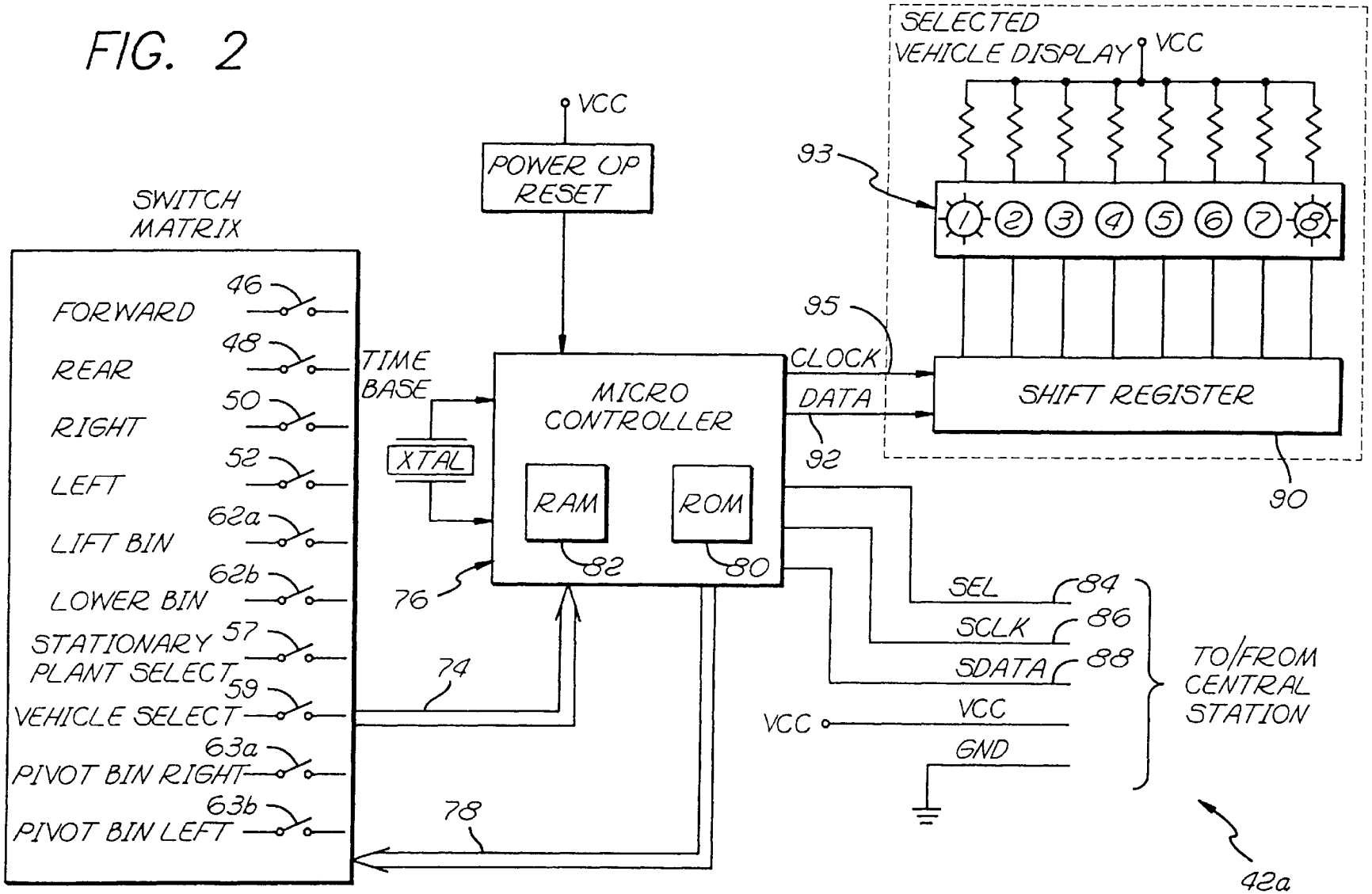
FIG. 2 is a schematic diagram, primarily in block form, of the different features in a pad included in the system shown in FIG. 1.

Each of the pads 42*a*, 42*b*, 42*c* and 42*d* may include a button 56 (FIG. 1) which is connected to a switch 57 (FIG. 2). Successive depressions of the button 56 on one of the pads within a particular period of time cause different ones of the stationary accessories or plants such as the pumping station 34 and the conveyor 38 to be energized. For example, a first depression of the button 56 in one of the pads 42*a*, 42*b*, 42*c* and 42*d* may cause the pumping station 34 to be energized and a second depression of the button 56 within the particular period of time in such pad may cause the conveyor 38 to be energized. When other stationary accessories are included in the system 10, each may be individually energized by depressing the button 56 a selective number of times within the particular period of time. When the button 56 is depressed twice within the particular period of time, the energizing of the pumping station 34 is released and the conveyor 38 is energized. This energizing of a selective one of the stationary accessories occurs at the end of the particular period of time.

A button 58 is provided in each of the pads 42*a*, 42*b*, 42*c* and 42*d* to select one of the vehicles 12, 14, 16 and 17. In the system disclosed and claimed in application Ser. No. 08/580,753, the individual one of the vehicles 12, 14, 16 and 17 selected at any instant by each of the pads 42*a*, 42*b*, 42*c* and 42*d* is dependent upon the number of times that the button is depressed in that pad within a particular period of time. The system disclosed and claimed in this invention operates in a similar manner. For example, one (1) depression of the button 58 may cause the dump truck 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may have the same duration as, or a different time than, the particular period of time for depressing the button 56. An adder is included in the pad 12 to count the number of depressions of the button 58 within the particular period of time. This count is converted into a plurality of binary signals indicating the count. The count is provided at the end of the particular period of time.

Buttons 60*a* and 60*b* are also included on each of the pads 42*a*, 42*b*, 42*c* and 42*d*. When depressed, the buttons 60*a* and 60*b* respectively close switches 62*a* and 62*b* in FIG. 2. The closure of the switch 62*a* is instrumental in producing an operation of the motor 32 in a direction to lift the bin 18 in the dump truck 12 when the dump truck has been selected by the proper number of depressions of the button 58. In like manner, when the dump truck 12 has been selected by the proper number of depressions of the switch 58, the closure of the switch 62*b* causes the selective one of the bin 18 in the dump truck 12 move downwardly as a result of the operation of the motor 32 in the reverse direction.

It will be appreciated that other controls may be included in each of the pads 42*a*, 42*b*, 42*c* and 42*d*. For example, buttons 61*a* and 61*b* may be included in each of the pads 42*a*, 42*b*, 42*c* and 42*d* to pivot the bin 18 to the right or left when the vehicle 12 has been selected. Such movements facilitate the ability of the bin 18 to scoop elements such as the blocks 24 and the marbles 26 upwardly from the floor or ground or from any other position and to subsequently deposit such elements on the floor or ground or any other position.

Switches 63*a* and 63*b* (FIG. 2) are respectively provided in the pad 42*a* in association with the buttons 61*a* and 61*b* and are closed by the respective actuation of the buttons 61*a* and 61*b* to move the bin or the platform in the vehicle 12 to the left or right when the vehicle has been selected. It will be appreciated that different combinations of buttons may be actuated simultaneously to produce different combinations of motions. For example, a bin in a selected one of the vehicles may be moved at the same time that the selected one of the vehicles is moved.

A central station generally indicated at 64 in FIG. 1 processes the signals from the individual ones of the pads 42*a*, 42*b*, 42*c* and 42*d* and sends the processed signals to the vehicles 12, 14, 16 and 17 when the button 58 on an individual one of the pads has been depressed to indicate that the information from the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16 and 17 to perform individual ones of the functions directed by the depression of the different buttons on the individual ones of the pads. When the commands from the individual ones of the pads 42*a*, 42*b*, 42*c* and 42*d* are to pass to the stationary accessories 34 and 38 as a result of the depression of the buttons 56 on the individual ones of the pads, the central station processes the commands and sends signals through cables 70 to the selected ones of the stationary accessories.

FIG. 2 shows the construction of the pad 42*a* in additional detail. It will be appreciated that each of the pads 42*b*, 42*c* and 42*d* may be constructed in a substantially identical manner to that shown in FIG. 2. As shown in FIG. 2, the pad 42*a* includes the switches 46, 48, 50 and 52 and the switches 57, 59, 62*a*, 62*b*, 63*a* and 63*b*. Buses 74 are shown as directing indications from the switches 46, 48, 50, 52, 57, 59, 62*a*, 62*b*, 63*a* and 63*b* to a microcontroller generally indicated at 76 in FIG. 2. Buses 78 are shown for directing signals from the microcontroller 76 to the switches.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the pad 42*a* provide indications of whether or not they have been closed. The random access memory 82 may receive this sequence from the read only memory 80 and may store indications of whether or not the switches in the particular sequence have been closed for each individual one of the pads 42*a*, 42*b*, 42*c* and 42*d*.

The pad 42*a* in FIG. 2 receives the interrogating signals from the central station 64 through a line 84. These interrogating signals are not synchronized by clock signals on a line 86. Each of the interrogating signals intended for the pad 42*a* may be identified by an address individual to such pad. When the pad 42*a* receives such interrogating signals, it sends to the central station 64 through lines 88 a sequence of signals indicating the status of the successive ones of the switches 46, 48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16 and 17.

As previously indicated, the pad 42*a* selects one of the vehicles 12, 14, 16 and 17 in accordance with the number of closings of the switch 59. As the user of the pad 42*a* provides successive actuations or depressions of the button 58, signals are introduced to a shift register 90 through a line 92 to indicate which one of the vehicles 12, 14, 16 and 17 would be selected if there were no further depressions of the button. Each one of the depressions of the button 58 causes the indication to be shifted to the right in the shift register 90. Such an indication is provided on an individual one of a plurality of light emitting diodes (LED) generally indicated at 93. The shifting of the indication in the shift register 90 may be synchronized with a clock signal on a line 95. Thus, the illuminated one of the light emitting diodes 93 at each instant indicates at that instant the individual one of the vehicles 12, 14, 16 and 17 that the pad 42*a* has selected at such instant.

Figure 3:
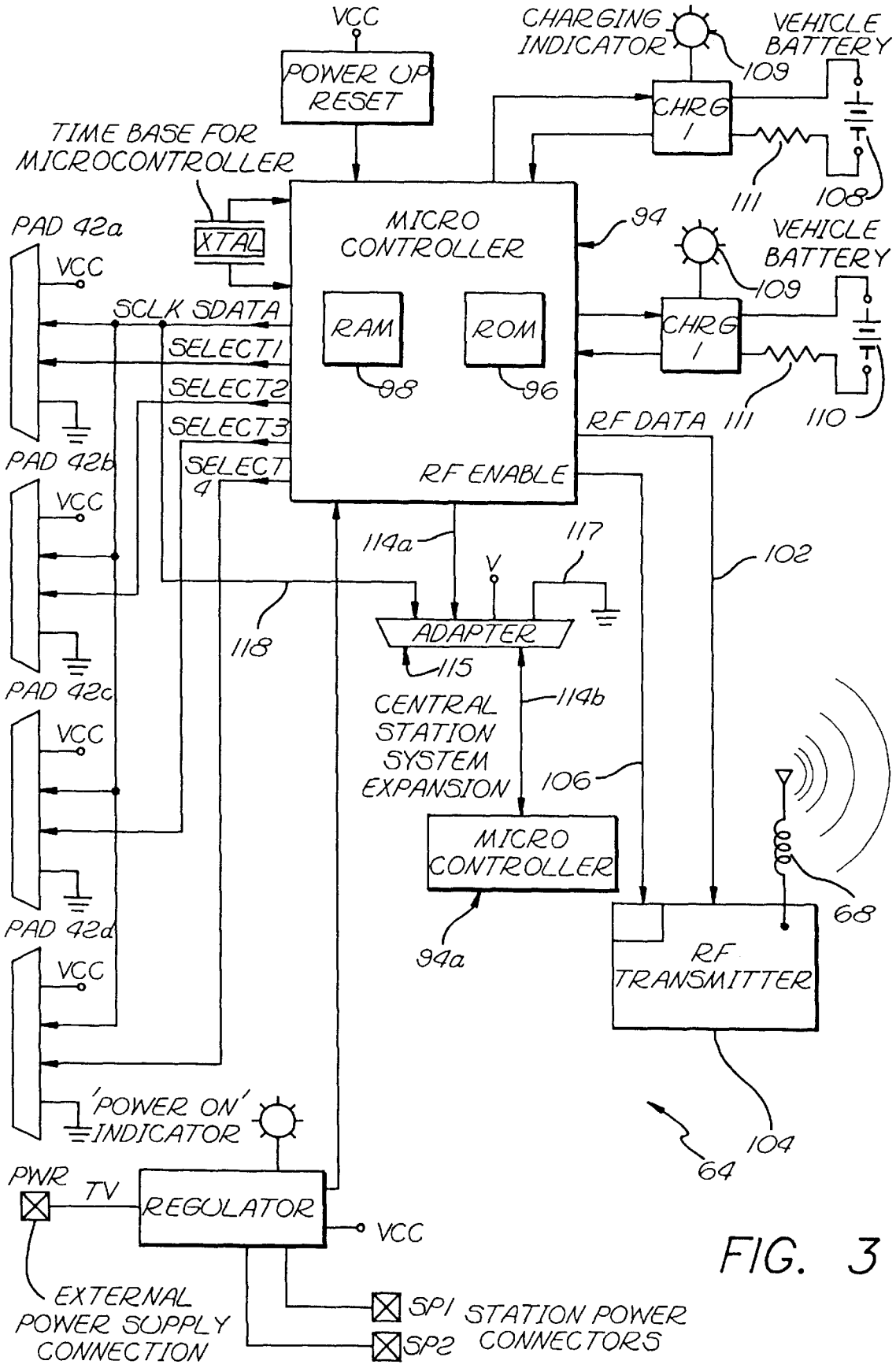
FIG. 3 is a schematic diagram, primarily in block form, of the different features included in a central station included in the system shown in FIG. 1.

The central station 64 is shown in additional detail in FIG. 3. It includes a microcontroller generally indicated at 94 having a read only memory (ROM) 96 and a random access memory (RAM) 98. As with the memories in the microcontroller 76 in the pad 42*a*, the read only memory 96 stores permanent information and the random access memory 98 stores volatile (or impermanent) information. For example, the read only memory 96 sequentially selects successive ones of the pads 42*a*, 42*b*, 42*c* and 42*d* to be interrogated on a cyclic basis. The read only memory 96 also stores a plurality of addresses each individual to a different one of the vehicles 12, 14, 16 and 17.

Since the read only memory 96 knows which one of the pads 42*a*, 42*b*, 42*c* and 42*d* is being interrogated at each instant, it knows the individual one of the pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the pad 42*a* can provide an address indicating the pad 42*a* when the microcontroller sends the binary signals relating to the status of the switches 46, 48, 50 and 52 and the switches 57, 59, 62*a*, 62*b*, 63*a* and 63*b* to the central station 64.

As an example of the information stored in the random access memory 98 in FIG. 3, the memory stores information relating to each pairing between an individual one of the pads 42*a*, 42*b*, 42*c* and 42*d* and a selective one of the vehicles 12, 14, 16 and 17 in FIG. 1 and between each individual one of such pads and a selective one of the stationary accessories 34 and 38. The random access memory 98 also stores the status of the operation of the switches 46, 48, 50 and 52 for each pad and the operation of the switches 57, 59, 62*a*, 62*b*, 63*a* and 63*b* for each pad.

When the central station 64 receives from the pad 42*a* the signals indicating the closure (or the lack of closure) of the switches 46, 48, 50 and 52 and the switches 57, 59, 62*a*, 62*b*, 63*a* and 63*b*, the central station retrieves from the read only memory 96 the address of the individual one of the vehicles indicated by the closures of the switch 59 in the pad. The central station may also retrieve the address of the pad 42*a* from the read only memory 96.

The central station 64 then formulates in binary form a composite address identifying the pad 42*a* and the selected one of the vehicles 12, 14, 16 and 17 and stores this composite address in the random access memory 98. The central station 64 then provides a packet or sequence of signals in binary form including the composite address and including the status of the opening and closing of each of the switches in the pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the pad 42*a* is introduced through a line 102 in FIG. 3 to a radio frequency transmitter 104 in the central station 64. The radio frequency transmitter 104 is enabled by a signal passing through a line 106 from the microcontroller 94. This enabling signal is produced by the microcontroller 94 when the microcontroller confirms that it has received signals from the pad 42*a* as a result of the interrogating signals from the central station 64.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central station 64 will respond to such packet of signals.

The microcontroller 94 stores in the random access memory 98 the individual ones of the vehicles such as the vehicles 12, 14, 16 and 17 being energized at each instant by the individual ones of the pads 42*a*, 42*b*, 42*c* and 42*d*. Because of this, the central station 64 is able to prevent the interrogated one of the pads 42*a*, 42*b*, 42*c* and 42*d* from selecting one of the energized vehicles. Thus, for example, if the vehicle 14 is being energized by one of the pads 42*a*, 42*b*, 42*c* and 42*d* at a particular instant, a first depression of the button 58 in the pad being interrogated at that instant will cause the vehicle 12 to be initially selected and a second depression of the button by such pad will cause the vehicle 14 to be skipped and the vehicle 16 to be selected.

Furthermore, in the example above where the pad 42*a* has previously selected the vehicle 14, the microcomputer 94 in the central station 64 will cause the vehicle 14 to be released when the pad 42*a* selects any of the vehicles 12, 16 and 17. When the vehicle 14 becomes released, it becomes available immediately thereafter to be selected by any one of the pads 42*a*, 42*b*, 42*c* and 42*d*. The release of the vehicle 14 by the pad 42*a* and the coupling between the pad 42*a* and a selected one of the vehicles 12, 14, 16 and 17 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central station 64 because the central station may receive AC power from a wall socket. The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged.

Each central station 64 may have the capabilities of servicing only a limited number of pads. For example, each central station 64 may have the capabilities of servicing only the four (4) pads 42*a*, 42*b*, 42*c* and 42*d*. It may sometimes happen that the users of the system may wish to be able to service more than four (4) pads. Under such circumstances, the microcontroller 94 in the central station 64 and a microcontroller, generally indicated at 94*a*, in a second central station corresponding to the central station 64 may be connected by cables 114*a* and 114*b* to an adaptor generally indicated at 115.

One end of the cable 114*b* is constructed so as to be connected to a ground 117 in the adaptor 115. This ground operates upon the central station to which it is connected so that such central station is a slave to, or subservient to, the other central station. For example, the ground 117 in the adaptor 115 may be connected to the microcomputer 94*a* so that the central station including the microcomputer 94*a* is a slave to the central station 64. When this occurs, the microcontroller 94 in the central station 64 serves as the master for processing the information relating to the four (4) pads and the four (4) vehicles in its system and the four (4) pads and the four (4) vehicles in the other system.

The expanded system including the microcomputers 94 and 94*a* may be adapted so that the address and data signals generated in the microcomputer 94*a* may be transmitted by the antenna 68 in the central station 64 when the central station 64 serves as the master station. The operation of the central station 64*a* may be clocked by the signals extending through a line 118 from the central station 64 to the adaptor 115 and through a corresponding line from the other central station to the adaptor.

Figure 4:
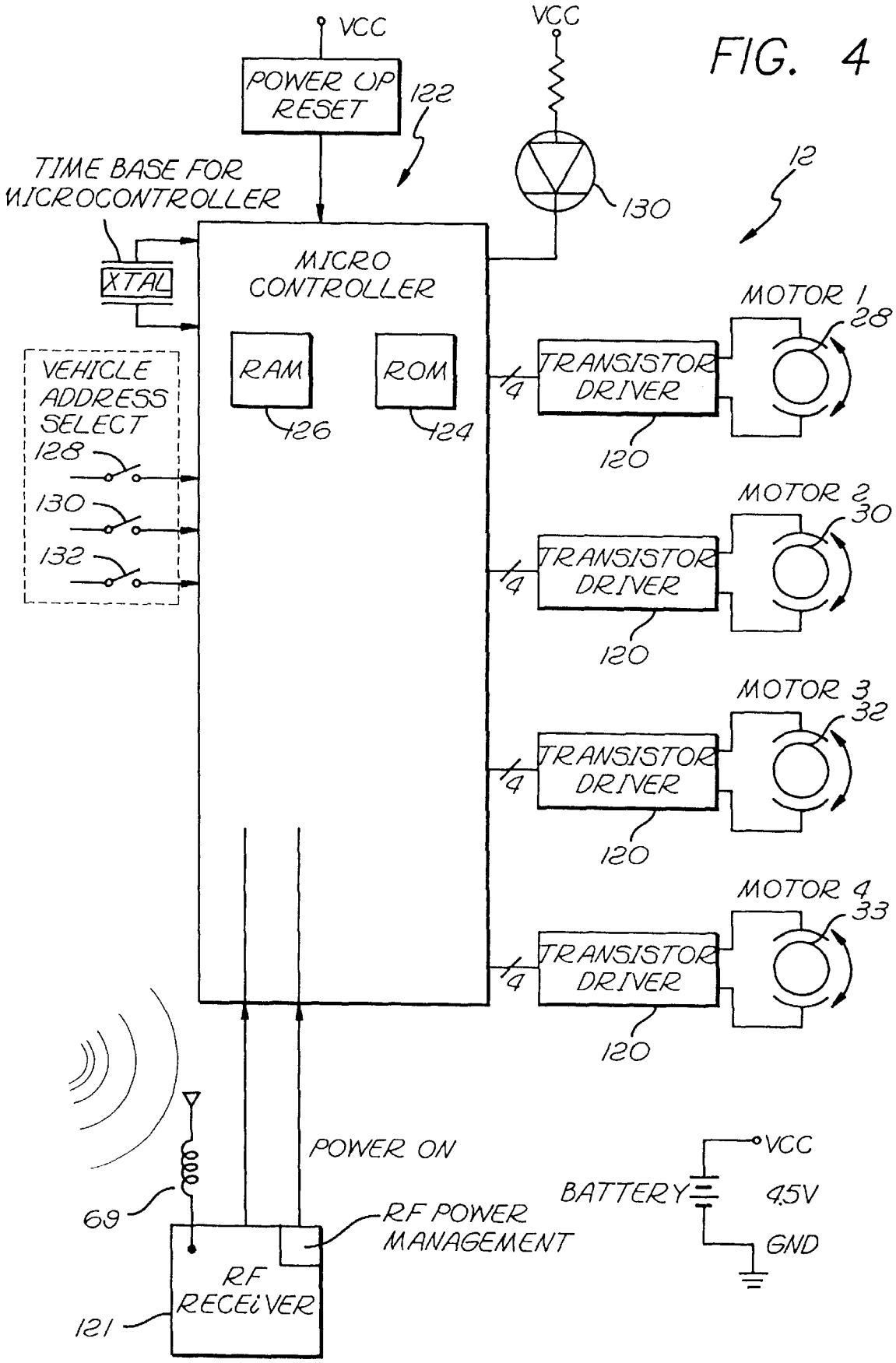
FIG. 4 is a schematic diagram, primarily in block form, of the different features in a vehicle included in the system shown in FIG. 1.

The vehicle 12 is shown in additional detail in FIG. 4. Substantially identical arrangements may be provided for the vehicles 14, 16 and 17. The vehicle 12 includes the antenna 69 for receiving from the central station 64 signals with the address of the vehicle and also includes a receiver 121 for processing the received signals. The vehicle 12 also includes the motors 28, 30, 32 and 33. Each of the motors 28, 30, 32 and 33 receives signals from an individual one of transistor drivers 120 connected to a microcontroller generally indicated at 122.

The microcontroller 122 includes a read only memory (ROM) 124 and a random access memory (RAM) 126. As with the memories in the pad 42*a* and the central station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

The vehicle 12 includes a plurality of switches 128, 130 and 132. These switches are generally pre-set at the factory to indicate a particular Arabian number such as the number "5". However, the number can be modified by the user to indicate a different number if two central stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17.

The pattern of closure of the switches 128, 130 and 132 in one of the vehicles can be changed when there is only a single central station. For example, the pattern of closure of the switches 128, 130 and 132 can be changed when there is only a single central station with a vehicle identified by the numeral "5" and when another user brings to the central station, from such other user's system, another vehicle identified by the numeral "5".

The vehicle 12 also includes a light such as a light emitting diode 130. This diode is illuminated when the vehicle 12 is selected by one of the pads 42*a*, 42*b*, 42*c* and 42*d*. In this way, the other users can see that the vehicle 12 has been selected by one of the pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected.

As previously indicated, the user of one of the pads such as the pad 42*a* selects the vehicle 12 by successively depressing the button 58 a particular number of times within a particular time period. This causes the central station 64 to produce an address identifying the vehicle 12. When this occurs, the central station 64 stores information in its random access memory 98 that the pad 42*a* has selected the vehicle 12. Because of this, the user of the pad 42*a* does not thereafter have to depress the button 58 during the time that the pad 42*a* is directing commands through the station 64 to the vehicle 12. As long as the buttons on the pad 42*a* are depressed within a particular period of time to command the vehicle 12 to perform individual functions, the microprocessor 94 in the central station 64 will direct the address of the vehicle 12 to be retrieved from the read only memory 96 and to be included in the packet of the signals transmitted by the central station to the vehicle 12.

The read only memory 96 in the microprocessor 94 at the central station 64 stores information indicating a particular period of time in which the vehicle 12 has to be addressed by the pad 42*a* in order for the selective coupling between the pad and the vehicle to be maintained. The random access memory 98 in the microcontroller 94 stores the period of time from the last time that the pad 42*a* has issued a command through the central station 64 to the vehicle 12. When the period of time in the random access memory 98 equals the period of time in the read only memory 96, the microcontroller 94 will no longer direct commands from the pad 42*a* to the vehicle 12 unless the user of the pad 42*a* again depresses the button 58 the correct number of times within the particular period of time to select the vehicle 12.

The vehicle 12 also stores in the read only memory 124 indications of the particular period of time in which the vehicle 12 has to be addressed by the pad 42*a* in order for the selective coupling between the vehicle and the pad to be maintained. This period of time is the same as the period of time specified in the previous paragraph. The random access memory 126 in the microcontroller 122 stores the period of time from the last time that the pad 42*a* has issued a command to the vehicle 12.

As previously indicated, the button 58 in the pad 42*a* does not have to be actuated or depressed to issue the command after the pad 42*a* has initially issued the command by the appropriate number of depressions of the button. When the period of time stored in the random access memory 126 of the microcomputer 122 in the vehicle equals the period of time in the read only memory 124, the microcontroller 122 issues a command to extinguish the light emitting diode 130. This indicates to the different users of the system, including the user previously controlling the operation of the vehicle 121 that the vehicle is available to be selected by one of the users including the user previously directing the operation of the vehicle.

When one of the vehicles such as the vehicle 12 is being moved in the forward direction, the random access memory 126 records the period of time during which such forward movement of the vehicle 12 is continuously occurring. This period of time is continuously compared in the microcontroller 122 with a fixed period of time recorded in the read only memory 124. When the period of time recorded in the random access memory 126 becomes equal to the fixed period of time recorded in the read only memory 124, the microcontroller 122 provides a signal for increasing the speed of the movement of the vehicle 12 in the forward direction. Similar arrangements are provided for each of the vehicles 14, 16 and 17. This increased speed may illustratively be twice that of the original speed.

The system and method described above and disclosed and claimed in co-pending application Ser. No. 08/580,753 have certain important advantages. They provide for the individual operation of a plurality of vehicles by a plurality of users, either on a competitive or a co-operative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also easily identified visually by the illumination of the lights 130 on the vehicle. The apparatus and method of this invention are also advantageous in that the vehicles are operated by the central station 64 on a wireless basis without any physical or cable connection between the central station and the vehicles.

Furthermore, the central station 64 is able to communicate with the vehicles in the plurality through a single carrier frequency. The system and method disclosed and claimed in application Ser. No. 08/580,753 are also advantageous in that the vehicles can selectively perform a number of different functions including movements forwardly and rearwardly and to the left and the right and including movements of a container or bin or platform on the vehicle upwardly and downwardly or to the left or the right. Different movements can also be provided simultaneously on a co-ordinated basis.

There are also other significant advantages in the system and method disclosed and claimed in application Ser. No. 08/580,753. Two or more systems can be combined to increase the number of pads 142 controlling the operation of the vehicles 12, 14, 16 and 17. In effect, this increases the number of users capable of operating the system. This combination of systems can be provided so that one of the systems is a master and the other is a slave. This prevents any confusion from occurring in the operation of the system. The system is also able to recharge the batteries in the vehicles so that use of the vehicles can be resumed after the batteries have been charged.

The system and method disclosed and claimed in application Ser. No. 08/580,753 are also advantageous in the provision of the pads and the provision of the buttons and switches in the pads. As will be appreciated, the pads are able to select vehicles and/or stationary accessories through the operation of a minimal number of buttons and to provide for the operation of a considerable number of different functions in the vehicles with a minimal number of buttons. In co-operation with the central station, the pads are able to communicate the selection of vehicles to the central station without indicating to the station, other than on a time shared basis, the identities of the vehicles being selected. After selecting a vehicle, each pad does not thereafter have to indicate the identity of the vehicle as long as the pad operates the vehicle through the central station within a particular period of time from the last operation of the vehicle by the pad through the central station.

This invention provides an improved system for providing selectable addresses in the vehicles 12, 14, 16 and 17. The invention includes a plurality of keys generally indicated at 150 and individually indicated at 150*a*, 150*b*, 150*c*, 150*d*, 150*e*, 150*f*, 150*g* and 150*h* in FIGS. 9 and 10. Each of the keys may have substantial dimensions so that they will not be easily lost by children using the vehicles. For example, the heighth of each key may be about three inches (3") and the width of each key may be about one and one half inches (1½"). The thickness of each key may be relatively small. Each key may be disposed in a vehicle which has a length of about six inches (6") and a width of about three inches (3") and a height of about three inches (3").

Figure 8:
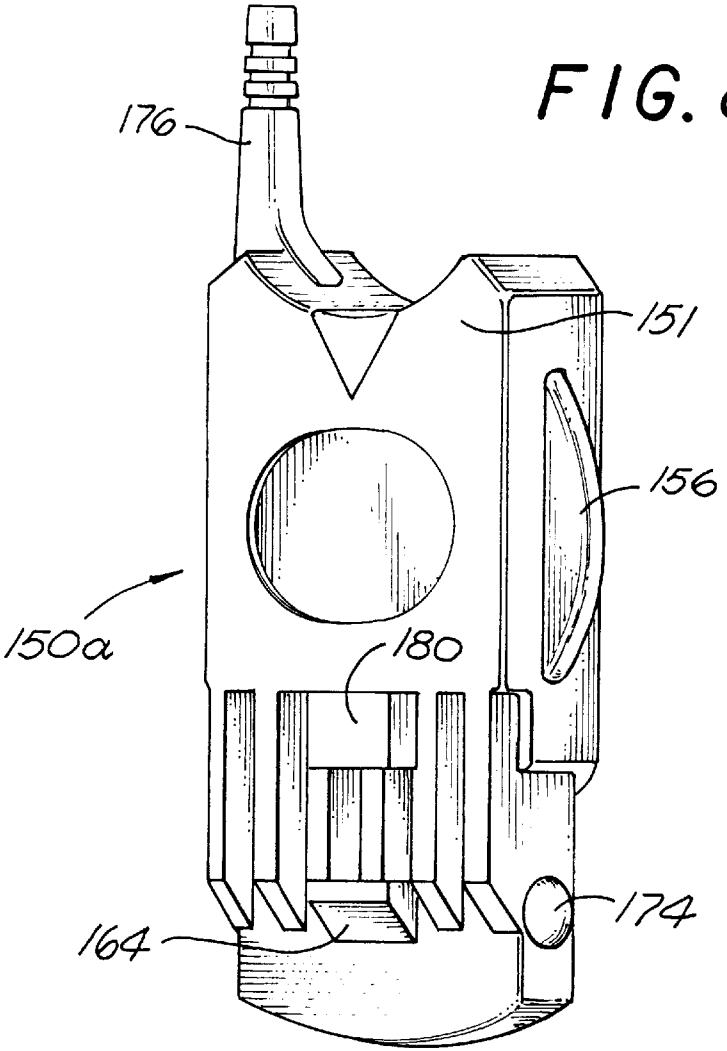
FIG. 8 is an enlarged perspective view of the key as seen from a position in back of and to one side of the key.
Figure 7:
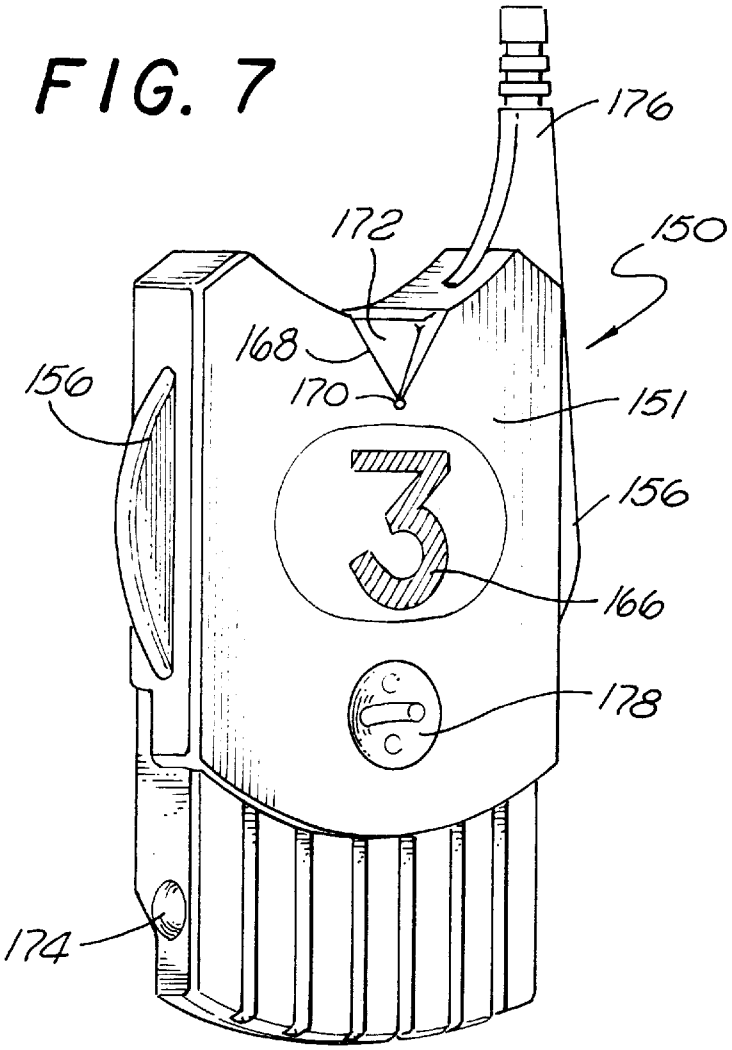
FIG. 7 is an enlarged perspective view of the key as seen from a position in front of and to one side of the key.
Figure 9D:
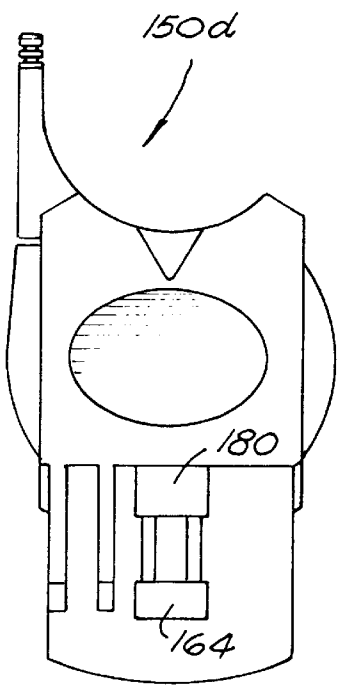
FIGS. 9*a*–9*h* are front elevational views of different keys each with an individual combination of ribs to provide an individual address to a vehicle in which such key is inserted.
Figure 10D:
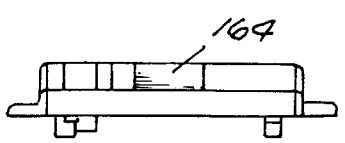
FIGS. 10*a*–10*h* are bottom plan views respectively of the keys shown in FIGS. 9*a*–9*h* and particularly show the disposition of the ribs which provide the individual address for each of the different keys.
Figure 9C:
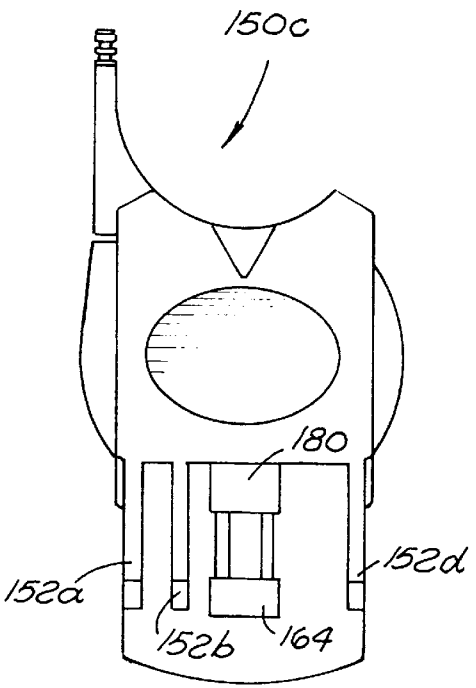
Figure 10C:
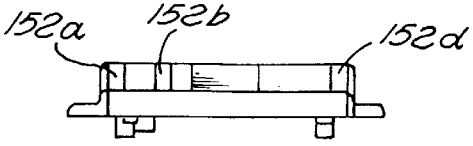
Figure 9B:
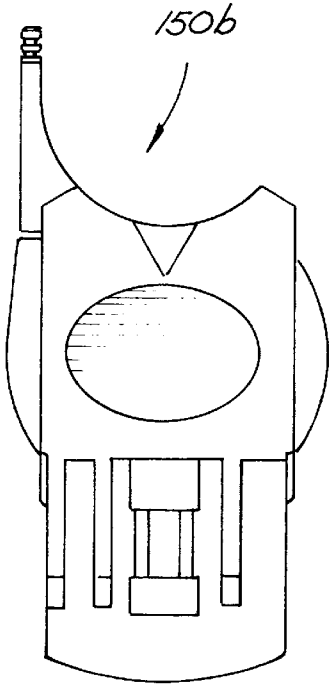
Figure 10B:
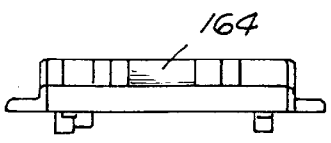
Figure 9A:
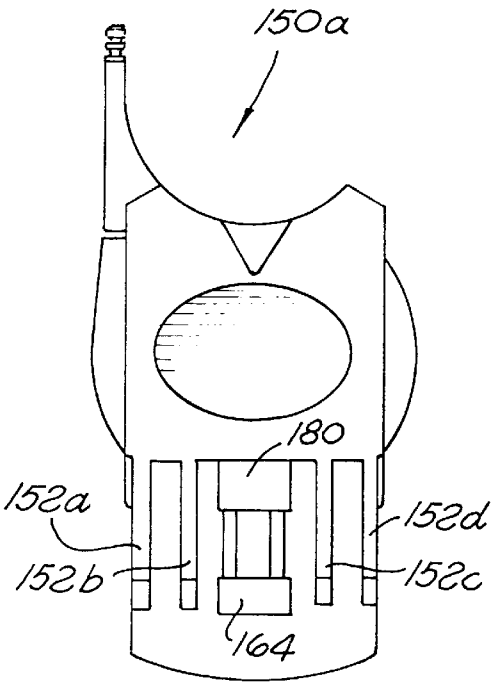
Figure 10A:
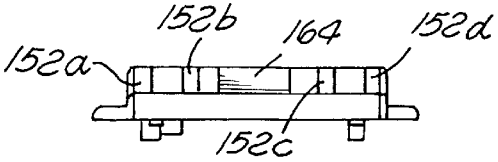
Figure 9H:
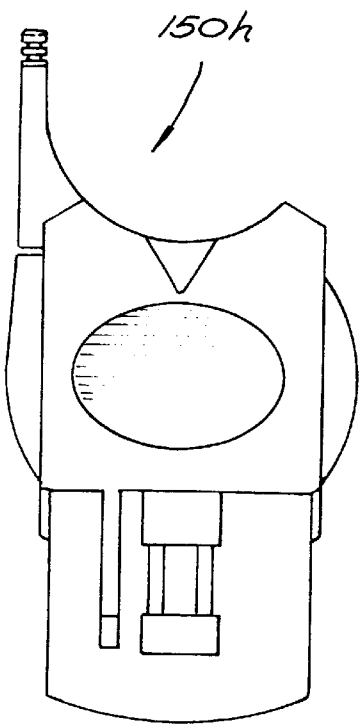
Figure 10H:
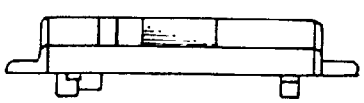
Figure 9G:
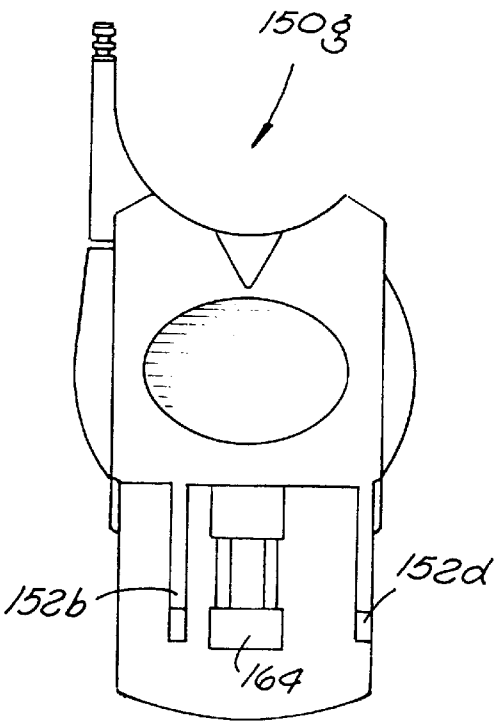
Figure 10G:
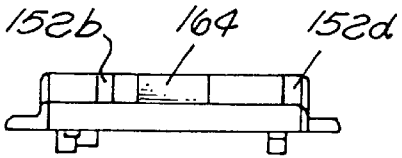
Figure 9F:
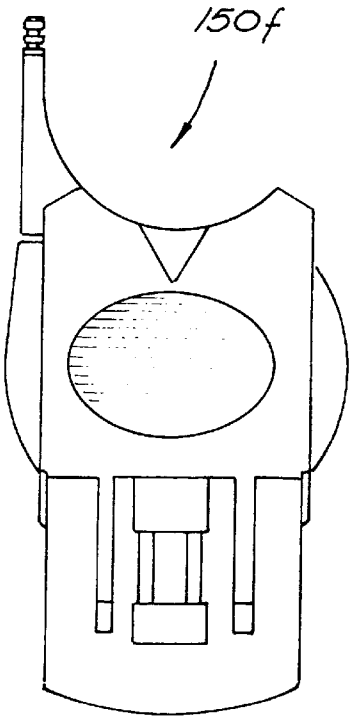
Figure 10F:
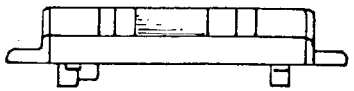
Figure 9E:
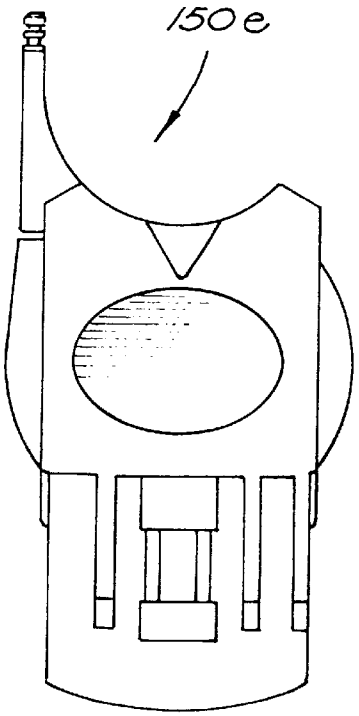
Figure 10E:
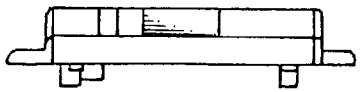

Each of the keys 150 has a body 151 (FIGS. 7 and 8). As will be seen from the subsequent discussion, each of the keys 150 is constructed to provide an address individual to that key. This may be seen from the following table where the left column indicates the individual ones of the keys 150*a*–150*h* and the right column indicates an address individually distinguishing each of the keys from the others:

| Key | Individual Address |
|---|---|
| 150a | 1 |
| 150b | 2 |
| 150c | 3 |
| 150d | 4 |
| 150e | 5 |

-continued

| Key | Individual Address |
|---|---|
| 150f | 6 |
| 150g | 7 |
| 150h | 8 |

Although the individual address for each key is shown as an Arabian integer, it will be appreciated that the individual address for such vehicle will probably be in an individual pattern of binary signals.

The body 151 on each of the keys 150*a*–150*h* is provided with an individual pattern of ribs 152*a*, 152*b*, 152*c* and 152*d*. (FIGS. 9 and 10). This may be seen from the following table indicating the individual pattern of ribs for each of the keys 150*a*–150*h*:

| Key | Individual Address-Pattern of Ribs |
|---|---|
| 150a | 152a, 152b, 152c, 152d |
| 150b | 152a, 152b, 152c |
| 150c | 152a, 152b, 152d |
| 150d | 152a, 152b |
| 150e | 152b, 152c, 152d |
| 150f | 152b, 152c |
| 150g | 152b, 152d |
| 150h | 152b |

It will be appreciated that sixteen (16) different combinations may be provided with the four (4) ribs 152*a*–152*d*. Only eight (8) combinations are shown in the table above and in FIGS. 9*a*–9*h* and 10*a*–10*h* on the assumption that the system will contain only eight (8) vehicles. However, sixteen (16) different vehicles may be identified by the different patterns of the ribs 152*a*–152*d*. It will also be appreciated that a different number of ribs then four (4) may be provided to change the number of vehicles that can be provided in the system.

Each of the keys 150*a*–150*h* is adapted to be disposed in a socket 154 (FIGS. 5 and 6) in any one of the vehicles 12, 14, 16 and 17. Each of the keys 150*a*–150*h* may be provided with guides 156 at its opposite sides (1) to fit in slots 157 in the socket and provide for a snug fit of the keys in the socket 154, (2) to provide for a controlled movement of the key into the socket, (3) to provide lateral stability to the key after the disposition of the key in the socket and (4) to prevent the key from coming out of the socket except by manual removal of the key from the socket.

Figure 11:
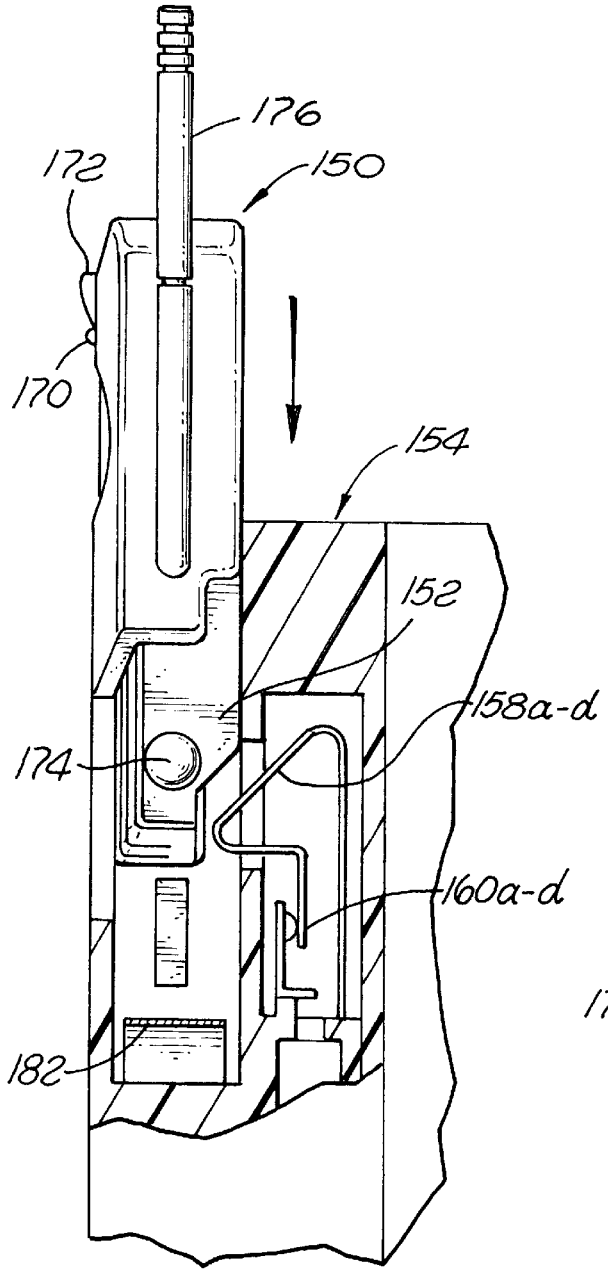
FIG. 11 is a fragmentary side elevational view, partly in section, of a vehicle and a key with the key partially inserted into a socket in the vehicle and shows the disposition of first switches in the vehicle with such partial insertion of the key into the socket.
Figure 12:
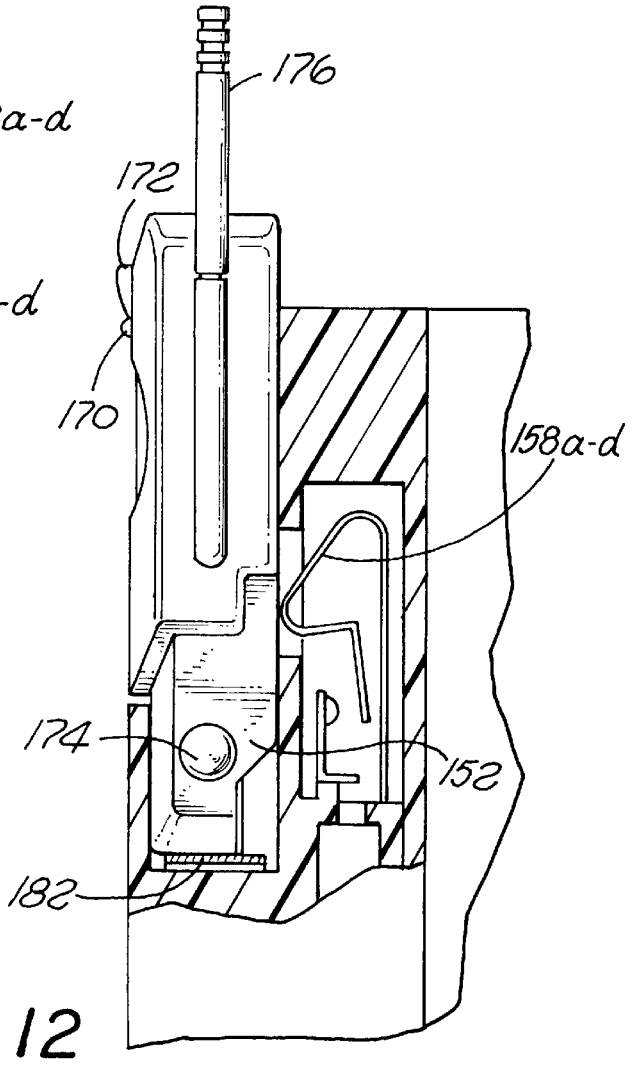
FIG. 12 is a fragmentary side elevational view, partly in section, of the vehicle and key shown in FIG. 11 and is similar to FIG. 11 except that it shows the key fully inserted into the socket in the vehicle and shows the disposition of the first switches in the vehicle with such full insertion of the key into the socket.

When one of the keys 150 (e.g. the key 150*d*) is disposed in the socket 154 of one of the vehicles (e.g. the vehicle 12), the ribs 152*a* and 152*b* in the key 150*d* engage springs 158*a* and 158*b* (FIGS. 11 and 12) operatively coupled to the movable contacts of a pair of switches 160*a* and 160*b* (included in a bank of switches 160*a*, 160*b*, 160*c* and 160*d*) and move these contacts from engagement with the stationary contacts of the switches. As a result, only the switches 160*c* and 160*d* remain closed. This causes the vehicle 12 to have an address identified by a binary pattern of 0011. As will be seen from the subsequent discussion, any one of the pads 42*a*, 42*b*, 42*c* and 42*d* can select the vehicle 12 by three (3) manual depressions of the button 58 in such pad within a particular period of time. The manual depression of the button 58 in the pad three (3) times within the particular period of time corresponds to the binary address of 0011 where the least significant bit is at the right.

The number of manual depressions of the button 58 to select an individual one of the vehicles may actually be dependent upon the previous actuation of the button. For example, the button 58 in a pad may have been previously actuated twice to select the vehicle identified by the numeral "2". If the user of such pad now desires to select the vehicle identified by the numeral "3", such user would only have to actuate the button 58 once. Similarly, if the user has previously selected the vehicle identified by the numeral "2" by actuating the pad twice and now desires to select vehicle identified by the numeral "1", the user would actuate the button 58 in the pad an additional seven (7) times.

An electrically conductive shorting bar 164 (FIGS. 8 and 9) is disposed between the ribs 152*a* and 152*b* and the ribs 152*c* and 152*d*. The bar 164 engages a pair of contacts 166*a* and 166*b* (FIGS. 13–15) and establishes a continuous circuit to the microcontroller 122 in the vehicle 12. This causes the microcontroller 122 in the vehicle 12 to reset all of the different parameters in the random access memory 126 to initializing values. For example, the random memory 126 in the vehicle 12 may be set to initializing values of zero (0) for the switches 160*a*–160*d*. After a brief period of time (e.g. ½ second) provided in the microcontroller 122, the microcontroller may then cause the pattern of 0011 to be provided in the random access memory 126 in the vehicle 12 in accordance with the pattern of the ribs in the key 150*d*.

A decal 166 (FIGS. 5 and 7) is disposed on the front and the rear of each of the keys 150 to identify that key by an individual Abrabian number. For example, the Arabian number "3" is disposed on the decal 166 which is disposed on the front of the key 150*d* to identify such key and distinguish such key from the other keys. A V-shaped cut 168 is provided on the top of each key 150 at the front and rear of the key. A light emitting diode (LED) 170 is disposed in each of the keys 150 at a position just below the neck of the V-shaped cut 168. A clear light conducting plastic 172 is disposed in the V-shaped cut 168 to conduct light from the light emitting diode 170. Electrically conductive pins 174 are provided on the opposite sides of each of the keys 150 near the bottom of the key to establish a continuous circuit to the light emitting diode 170 when the key is inserted in the socket 154 in the vehicle such as the vehicle 12.

A finger 176 made from a suitable material such as rubber and looking like an antenna (but not actually an antenna) may extend upwardly from the top of each of the keys 150. The finger 176 is provided to add a semblance of high level technology to the key 150, particularly for young children. However, the finger 176 has no utility in the key. A button 178 below the decal 166 also has no utility in the key.

When the key 150*d* is inserted into the socket 154 of the vehicle 12, the bar 164 establishes an electrical circuit across the switches 166*a* and 166*b* and causes the microcontroller 122 to initialize all of the parameters in the random access memory 126 and to initialize the address of the vehicle in the random access memory 126. Although the switches 150*b* and 150*d* are closed at the same time as the switches 166*a* and 166*b*, the microcontroller 122 in the vehicle 12 does not establish the address of the vehicle in the random access memory 126 until after the parameters have been initialized by the closure of the switches 166*a* and 166*b* as discussed above.

The microcontroller 122 causes the vehicle 12 to operate in the inactive but powered state when the address of the vehicle 12 has been entered into the random access memory 126 as a result of the disposition of the key 150*d* in the socket 154. In the inactive but powered state, the vehicle 12 is capable of receiving from any of the pads 42*a*, 42*b*, 42*c* and 42*d* the address entered into the random access memory 126. When the vehicle 12 receives this address from an individual one of the pads 42*a*–42*d*, it operates in accordance with commands received from such individual one (e.g. the pad 42*b*) of the pads.

The light emitting diode 170 is continuously illuminated in accordance with instructions from the microcontroller 122 during the time that the individual one of the pads 42*a*–42*d* (e.g. the pad 42*b*) is operating the vehicle. This illumination is visible to the users of all of the pads 42*a*–42*d* because of the diffusion of the light from the light emitting diode 170 through the light conducting plastic 172. It indicates to all of the users that the vehicle 12 is being commanded by one of the pads (e.g. the pad 42*b*) and is not available to be operated by any of the other pads.

The continuous illumination of the light emitting diode 170 exists as long as the user of the pad 42*b* continues to issue commands to the vehicle 12 within a first particular period of time after the last time that such pad has issued a command to such vehicle. If the pad 42*b* fails to issue any command to the vehicle 12 within such first particular period of time, the microcontroller 122 in the vehicle 12 causes the vehicle to operate in the inactive but powered state. In this state, the vehicle is able to be selected by any of the pads including the pad 42*b*. In the inactive but powered state of the vehicle 12, the microcontroller 122 causes the light emitting diode 170 to be illuminated periodically. In other words, the light emitting diode 170 is blinked on and off at a particular rate.

When the vehicle 12 is in the inactive but powered state, it can be addressed by any of the pads 42*a*–42*d* including the pad 42*b*, which previously addressed the vehicle. Assume that the pad 42*c* addresses the vehicle 12 while the vehicle is in the inactive but powered state. The vehicle 12 will now be commanded by the pad 42*c* to operate until such time as the pad 42*c* fails to issue a command to the vehicle within the first particular period of time after the last issuance of a command from the pad to the vehicle. The vehicle will also operate in the inactive but powered state when the pad 42*a* has previously selected and operated the vehicle and the pad now selects and operates a different vehicle such as the vehicle 14. The microcontroller 94 in the central station keeps account of this.

As will be seen, the vehicle 12 is in the inactive but powered state under three (3) different circumstances. One circumstance occurs when one of the keys 150 is inserted in the socket 154 in the vehicle 12. The second circumstance occurs when one of the pads (e.g. the pad 42*a* ) selects the vehicle 12 and then fails to issue a command to the vehicle within the first particular time after the last issuance of a command from the pad to the vehicle. The third circumstance occurs as discussed in the next-to-last sentence of the previous paragraph.

The vehicle 12 is programmed to remain in the inactive but powered state for a second particular period of time independent of the first particular period of time. If the vehicle 12 is not addressed by any of the pads 42*a*–42*b* in the second particular period of time, the vehicle becomes de-activated. Alternatively, if no commands have been given by any of the pads 42*a*–42*d* to any of the vehicles in the second particular period of time, all of the vehicles become de-activated. When the vehicle 12 becomes de-activated, the light emitting diode 170 is not illuminated. This indicates to the users that power has been removed from the vehicle.

Figure 15:
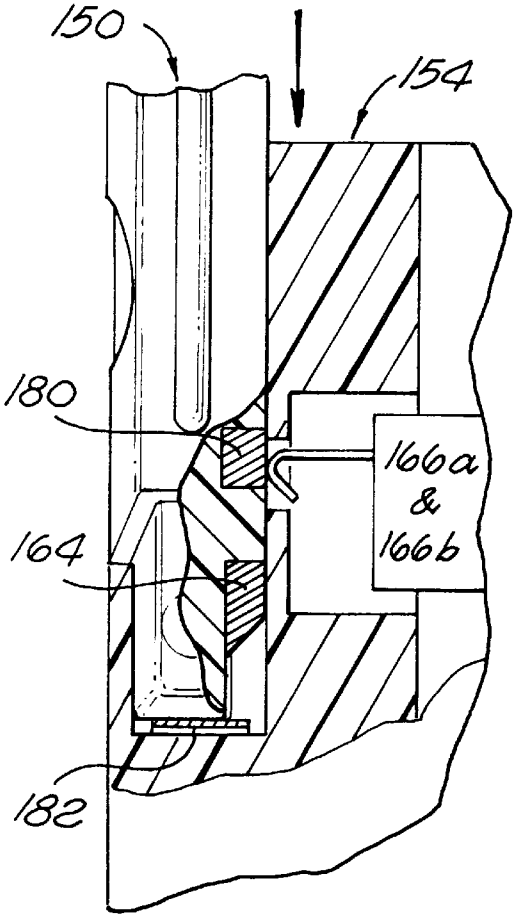
FIG. 15 is a fragmentary side elevational view, partly in section, of the vehicle and the key shown in FIGS. 11–14 and shows a third particular disposition of the key in the vehicle socket and the disposition of the electrical contacts in the vehicle with such a relationship between the key and the vehicle.

As previously described, the bar 164 establishes an electrical continuity between the switches 166*a* and 166*b* when the key 150 is inserted into the socket 154 in the vehicle 12. To insure that the ribs 152*a* and 152*b* in the key 150*d* will continue to engage the movable contacts of the associated switches 160*a* and 160*b*, the key 150*d* continues to move into the socket 154 to a position between the bar 164 and a bar 180 directly above the bar 164. This is indicated in FIG. 15. The bar 180 corresponds in construction and operation to the bar 164. In the position shown in FIG. 15, the contacts 166*a* and 166*b* are not shorted.

Figure 14:
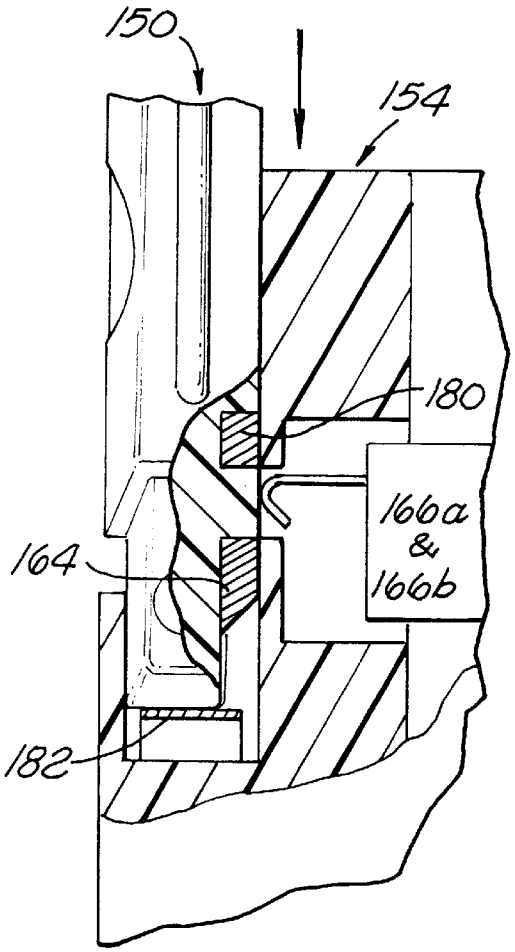
FIG. 14 is a fragmentary side elevational view, partly in section, of the vehicle and the key shown in FIGS. 11–13 and shows a second particular disposition of the key in the vehicle socket and the disposition of the electrical contacts in the vehicle with such a relationship between the key and the vehicle.

If the vehicle 12 should become de-activated as discussed above and a user should thereafter wish to operate the vehicle, the user presses the key 150*d* downwardly until the bar 180 engages the contacts 166*a* and 166*b*. This is shown in FIG. 15. This causes the contacts 166*a* and 166*b* to be shorted, causing the microcontroller 122 to be initialized and the random access memory 126 to receive the address of the key 150*d*. The vehicle 12 then becomes operative in the inactive but powered state as discussed above. When the key 150*d* is released, the key is moved by the action of a spring 182 back to a position where the contacts are between the bars 164 and 180 in displaced relationship to the bars. This position is shown in FIG. 15. In this way, the key 150*d* can be moved downwardly again into continuity with the contacts 166*a* and 166*b* (which constitute a switch with the bar 164 or the bar 180) if the vehicle should thereafter be de-activated again. This continuity is established by the action of the bar 180 on the switches 166*a* and 166*b* as shown in FIG. 14.

Figure 13:
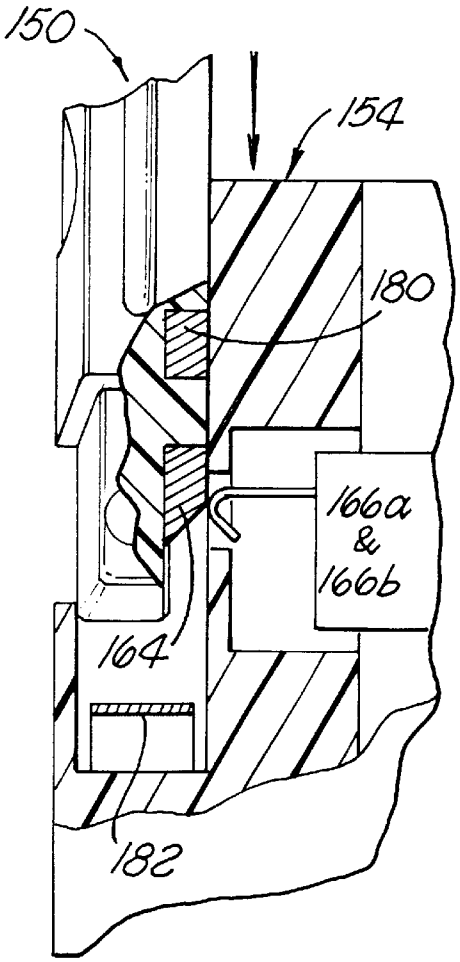
FIG. 13 is a fragmentary side elevational view, partly in section, of the vehicle and the key shown in FIGS. 11 and 12 and shows a first particular disposition of the key in the vehicle socket and the disposition of electrical contacts in the vehicle with such a relationship between the key and the vehicle.

FIG. 13 shows the key in position in the socket so that the bar 164 establishes continuity with the contacts 166*a* and 166*b*. FIG. 14 shows the key in position in the socket so that non-conductive material in the key engages the contacts 166*a* and 166*b*. In this position, no electrical continuity is established between the contacts 166*a* and 166*b*. FIG. 15 shows the key in position in the socket so that the bar 180 establishes continuity with the contacts 166*a* and 166*b*.

The system and method disclosed above have certain important advantages. They provide for the insertion of one of the keys 150 (e.g. the key 150*d*) into the socket 154 in one of the vehicles (e.g. the vehicle 12) to provide the vehicle with an address individual to such key. They also provide for the initializing of the parameters in the random access memory 126 in the vehicle 12. The vehicle 12 can then be selected by any of the pads 42*a*–42*b* by operating the button 58 a number of times dependent upon the individual number (e.g. "3") provided for the vehicle by the key 150*d*.

The system and method disclosed above have other important advantages. They provide for the operation of the vehicle 12 by the pad 42*a* (by way of example) after the vehicle is selected by the pad. If the pad 42*a* fails to operate the vehicle within the first particular period of time, the vehicle becomes inactive but powered and can be selected by any of the pads including the pad 42*a*. If any of the three (3) circumstances discussed above then occurs, the vehicle becomes de-activated. The vehicle can again become inactive but powered by pressing the key 150*d* downwardly in the socket 154.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

We claim:

1. In combination for use in a system including a plurality of pads each operable to provide an address and commands, a key, a vehicle having a socket for receiving the key, a plurality of switches disposed in the vehicle adjacent the socket, each of the switches having first and second contacts, the first contact in each switch being movable relative to the second contact in the switch between a first position providing a closure with the second contact and a second position providing an opening with the second contact, the key being insertable into the vehicle socket, the key having bumps at strategic positions along the length of the key to move the first contacts of the switches in the vehicle at the strategic positions to the first position, the pattern of the bumps for the key being individual to the key to provide the vehicle with an address dependent upon the pattern of the bumps in the key, and means in the vehicle for responding to an address transmitted to the vehicle from one of the pads corresponding to the address established in the vehicle by the key and for responding to commands transmitted to the vehicle from the pad.

2. In a combination as set forth in claim 1, the responding means including a microcontroller in the vehicle for storing the address established in the vehicle by the pattern of the switch closures and including means for comparing the address transmitted from the pad with the address stored in the microcontroller to activate the vehicle when the comparing means indicates correspondence between the stored address and the address transmitted from the pad.

3. In a combination as set forth in claim 2, means in the vehicle for resetting the microcontroller in response to the insertion of the key in the vehicle socket, and means in the vehicle for storing in the microcontroller the address represented by the key after the microcontroller has been reset.

4. In a combination as set forth in claim 1, means in the vehicle for maintaining the vehicle activated in accordance with the reception by the vehicle of commands from the pad within a particular time period from the last previous command from the pad and for inactivating the vehicle, but retaining the vehicle powered, when one of the following occurs: (1) the vehicle fails to receive a command from the pad within the particular time period, and (2) the pad addresses another one of the vehicles.

5. In a combination as set forth in claim 4, the vehicle constituting one of a plurality the particular time period constituting a first particular time period, and means for de-activating the vehicle when one of the following occurs: (1) the vehicle fails to receive from any of the pads the address in the vehicle during a second particular period of time after the vehicle has been inactivated but powered and (2) none of the pads addresses any of the vehicles in the second particular period of time.

6. In a combination as set forth in claim 5, the responding means including a microcontroller in the vehicle for storing the address of the vehicle and including means for comparing the addresses transmitted from the pads with the address stored in the microcontroller to activate the vehicle when the comparing means indicates correspondence between the stored address and the address transmitted from one of the pads, means in the vehicle for resetting the microcontroller in response to the insertion of the key in the vehicle socket, and means in the vehicle for storing in the microcontroller the address represented by the key after the microcontroller has been reset.

7. In combination for use in a system including a plurality of pads each operable to provide an address and commands with the address, a vehicle constituting one of a plurality of vehicles, a plurality of switches in the vehicle, means insertable into the vehicle for mechanically operating the switches between open and closed positions to provide an address for the vehicle in accordance with the pattern of the opening and the closing of the switches by the insertable means, means responsive in the vehicle to the reception of the address from one of the pads and to commands accompanying the address from the pad for operating the vehicle in accordance with the commands, means in the vehicle for continuing to operate the vehicle for a first period of time in accordance with the last command from the pad before the commencement of the first period of time even when no command is received from the pad during the first period of time, and means operative in the vehicle at the end of the first period of time for (1) inactivating the vehicle, while retaining the vehicle powered, when the vehicle has not received a command from the pad during the first period of time and (2) inactivating the vehicle, while retaining the vehicle powered, when the pad addresses another one of the vehicles.

8. In a combination as set forth in claim 7, means operative in the vehicle, during the period of time that the vehicle is inactive but powered, for responding to the address of the vehicle and an accompanying command from any one of the pads to operate the vehicle in accordance with the accompanying command.

9. In a combination as set forth in claim 7, means in the vehicle for responding only to the commands from the pad after the addressing of the vehicle by the pad and until the time when the vehicle becomes inactive but powered.

10. In a combination as set forth in claim 8, means operative in the vehicle for de-activating the vehicle, after the vehicle has become powered but inactive, when one of the following occurs: (1) the vehicle fails to receive the address from any of the pads for a second period of time after the first period of time, the second period of time being unrelated to the first period of time and (2) none of the pads gives a command to any of the vehicles during the second period of time.

11. In a combination as set forth in claim 10, means in the vehicle for responding only to the commands from the pad after the addressing of the vehicle by the pad and until the time when the vehicle becomes inactive but powered.

12. In combination for use in a system including a plurality of pads each operable to provide an address and commands with the address, a vehicle, a plurality of switches in the vehicle, means in the vehicle for mechanically operating the switches between open and closed positions in a pattern providing an address for the vehicle, a microcontroller in the vehicle, the microcontroller being operable to be set to the address for the vehicle and to be reset for subsequent setting to an address different than the address for the vehicle, means operable in conjunction with the mechanical opening and closing of the switches in the pattern providing for the address of the vehicle for resetting the microcontroller, means in the microcontroller for setting the address of the vehicle in the microcontroller after the resetting of the microcontroller, means responsive in the vehicle after the setting of the address of the vehicle in the microcontroller, to the reception of the address from one of the pads and to commands accompanying the address from the pad for operating the vehicle in accordance with the commands, and means in the vehicle for setting the vehicle to an inactive but powered state when one of the following occurs: (1) the pad fails to communicate a command to the vehicle for a first period of time after a last communication of a command to the vehicle from the pad and (2) the pad selects another one of the vehicles.

13. In a combination as set forth in claim 12, means in the vehicle for operating the vehicle in accordance with the commands from the pad even when the commands from the pad are not preceded in the pad by the address of the vehicle.

14. In a combination as set forth in claim 12, a key, means in the vehicle for receiving the key, the key being constructed for operation in combination with the vehicle and with the microcontroller in the vehicle, when the key is received in the vehicle, for resetting the microcomputer and for thereafter setting the microcontroller to an address provided by the key.

15. In a combination as set forth in claim 12, means in the vehicle for de-activating the vehicle when one of the following occurs while the vehicle is in the inactive but powered state: (1) the vehicle fails to receive the address for a second period of time from any of the pads and (2) none of the pads issues a command to any of the vehicles for the second period of time.

16. In a combination as set forth in claim 15, means in the vehicle for operating the vehicle in accordance with the commands from the pad even when the commands from the the pad are not accompanied in the pad by the address of the vehicle, means in the vehicle for de-activating the vehicle when one of the following occurs while the vehicle is in the inactive but powered state: (1) the vehicle fails to receive the address of the vehicle for a second period of time from any of the pads and (2) none of the pads gives a command to any of the vehicles for the second period of time.

17. In combination for use in a system including a plurality of pads each operable to provide an address and commands with the address, a vehicle, first switches in the vehicle, means in the vehicle for mechanically operating the first switches between open and closed positions in a pattern to provide an address for the vehicle in accordance with the pattern of the opening and closing of the first switches, a microcontroller settable in the vehicle to the address in accordance with the pattern of the opening and closing of the first switches in the vehicle, the microcontroller being operative to store the address to which it has been set, first means including a second switch in the vehicle for resetting the microcontroller before the setting of the microcontroller to the address by the first switches, and second means responsive to the setting of the address in the microcomputer and to the address transmitted to the vehicle from one of the pads and to commands transmitted, with the address, to the vehicle from the pad for operating the vehicle in accordance with the commands.

18. In a combination as set forth in claim 17, a socket in the vehicle, and the mechanically operating means including a key insertable into the socket to set the first switches into the pattern providing the address of the vehicle and to operate the second switch to reset the micro controller.

19. In a combination as set forth in claim 18, each of the first switches having first and second contacts, the key having bumps each disposed to engage the first contact of one of the first switches for displacement relative to the second contact of such switch upon the insertion of the key into the socket in the vehicle, the key being constructed to provide electrical continuity in the second switch upon the insertion of the key into the socket in the vehicle to obtain a resetting of the microcontroller.

20. In a combination as set forth in claim 17, the vehicle including wheels and first motors operatively coupled to the wheels to move the vehicle forwardly and rearwardly and to turn the vehicle, the vehicle also including a working member movable in the vehicle and a second motor for moving the working member the second means including third means for operating the first motors in accordance with the commands from the pad to propel the vehicle, the second means including fourth means for operating the second motor in accordance with the commands the pad to move the working member.

21. In a combination as set forth in claim 20, a socket in the vehicle, and the mechanically operating means including a key insertable into the socket to set the first switches into the pattern providing the address of the vehicle and to operate the second switch to reset the microcomputer, each of the first switches having first and second contacts, the key having bumps each disposed to engage the first contact of one of the first switches for displacement relative to the second contact of the switch upon the insertion of the key into the socket in the vehicle, the key being constructed to provide electrical continuity in the second switch upon the insertion of the key into the socket in the vehicle to obtain a resetting of the microcontroller.

22. In combination for use in a system including a plurality of pads each operable to provide an address and commands with the address, a key, a vehicle having a socket for receiving the key, a microcontroller in the vehicle, first switches operable in the vehicle to set the microcontroller to an address dependent upon the operation of the switches, a second switch operable in the vehicle to reset the microcontroller to a neutral value not indicative of any address, the key being constructed, upon the reception of the key in the vehicle socket, to operate the first and second switches; and means in the vehicle for initially resetting the microcontroller to the neutral value in accordance with the operation of the second switch by the key and for then setting the microcontroller to the address of the vehicle in accordance with the operation of the first switches by the key.

23. In a combination as set forth in claim 22, means responsive in the vehicle to the address from one of the pads and to commands from the pad for operating the vehicle in accordance with such commands.

24. In a combination as set forth in claim 23, the vehicle being one of a plurality of vehicles, means in the vehicle, including the microcontroller, for disposing the vehicle in an inactive but powered state when one of the following occurs: (1) the vehicle fails to receive a command from the pad for a first time after the last previous reception by the vehicle of a command from the pad (2) the key is initially disposed in the vehicle socket and (3) the pad selects another one of the vehicles, and means in the vehicle for responding in the inactive but powered state to the address from any one of the pads and to commands accompanying the address to operate the vehicle in accordance with the commands.

25. In a combination as set forth in claim 24, means in the vehicle, including the microcontroller, for de-activating the vehicle when one of the following occurs while the vehicle is the inactive but powered state: (1) the vehicle fails to receive the address from any one of the pads during a second period of time and (2) none of the pads gives a command to any of the vehicles during the second period of time.

26. In a combination as set forth in claim 25, detent means in the socket and in the key for cooperating with each other to retain the key in a position in the socket in the vehicle to operate the first switches for providing the address in the microcontroller, the key and the socket being constructed for movement of the detent means in the key past the detent means in the socket to a position for operating the second switch to obtain a resetting of the microcontroller and a setting again of the microcontroller to the address.

27. In a combination as set forth in claim 22, detent means in the socket and in the key for cooperating with each other to retain the key in a position in the socket in the vehicle to operate the first switches for providing the address in the microcontroller.

28. In a combination as set forth in claim 27, the key and the socket being constructed for movement of the detent means in the key past the detent means in the socket to a position for obtaining a resetting of the microcontroller and a setting again of the microcontroller to address of the vehicle.

29. In combination for use in a system including a plurality of pads each operable to provide an address and commands with the address, a vehicle, a microcontroller in the vehicle, first means in the vehicle, including the microcontroller, for providing the vehicle with an address, second means responsive in the vehicle to the transmission of the address and commands from one of the pads and to the transmission of commands with the address from the pad for operating the vehicle in an active and powered state in accordance with the commands, third means responsive in the vehicle to the operation of the vehicle in the active and powered state in accordance with the commands from the pad for providing a first illumination of the vehicle, fourth means responsive in the vehicle to the failure of the vehicle in the active and powered state to receive commands from the pad for a first period of time after a last reception of a command from the pad for operating the vehicle in an inactive but powered state, and fifth means responsive in the vehicle to the operation of the vehicle in the inactive but powered state for providing a second illumination of the vehicle different from the first illumination of the vehicle.

30. In a combination as set forth in claim 29, sixth means responsive in the vehicle to the reception of a command by the vehicle from the pad in the active and powered state during the first time period for instituting a new count in the vehicle of the first time period.

31. In a combination as set forth in claim 29, sixth means for deactivating the vehicle in response to one of the following: (1) a failure of the vehicle in the inactive but powered state to receive the address from any of the pads in a second period of time and (2) a failure of any of the pads to give a command to any of the vehicles in the second period of time, and seventh means responsive to the de-activation of the vehicle for providing a third state of illumination of the vehicle.

32. In a combination as set forth in claim 29, sixth means responsive in the vehicle to the failure of the vehicle to receive a command from the pad in the active and powered state for the first period of time for responding to the address and commands from any of the pads in the inactive but powered state to provide an operation of the vehicle in the active and powered state in accordance with such commands, the third means being operative in the active and powered state in accordance with the response by the sixth means for providing the first illumination of the vehicle.

33. In a combination as set forth in claim 32, seventh means responsive in the vehicle to the reception of a command by the vehicle from the pad during the first period of time for instituting a new count of the first period of time in the vehicle, eighth means for de-activating the vehicle in response to one of the following: a failure of the vehicle in the inactive but powered state to receive the address from any of the pads in a second period of time and (2) a failure of any of the pads to give a command to any of the vehicles in the second period of time, and ninth means responsive to the de-activation of the vehicle for providing a third state of illumination of the vehicle.

34. In combination for use in a system including a plurality of pads each operable to provide an address and commands with the address, a vehicle included in a plurality of vehicles, a microcontroller in the vehicle, first means in the vehicle, including the microcontroller, for providing the vehicle with an address, second means in the vehicle, including the microcontroller, for disposing the vehicle in an inactive but powered state after the vehicle has been provided with the address, third means in the vehicle for measuring the period of time, after the provision of the address in the vehicle, during which the vehicle is in the inactive but powered state, and fourth means in the vehicle for de-activating the vehicle when one of the following occurs: (1) the vehicle fails to receive the address from any of the pads for a first period of time after the vehicle has become operative in the inactive but powered state and (2) none of the pads addresses any of the vehicles for the first period of time.

35. In a combination as set forth in claim 34, fifth means in the vehicle for providing a first state of illumination when the vehicle is in the inactive but powered state, and sixth means in the vehicle for providing a second state of illumination in the vehicle when the vehicle becomes de-activated.

36. In a combination as set forth in claim 34, a socket in the vehicle, and a key disposable in the vehicle for providing the vehicle with the address.

37. In a combination as set forth in claim 34, fifth means responsive in the vehicle to the address and commands from any one of the pads during the operation of the vehicle in the inactive but powered state and to the commands accompanying such address for operating the vehicle in an active and powered state in accordance with such commands, and sixth means responsive in the vehicle to the operation of the vehicle by the fifth means for providing a third state of illumination in the vehicle.

38. In a combination as set forth in claim 37, seventh means responsive in the vehicle to each operation of the vehicle by the fifth means for initiating a count of the time until the next operation of the vehicle by the fifth means, and eighth means responsive in the vehicle to the count by the seventh means of a second period of time during the operation of the vehicle in the active and powered state for disposing the vehicle in the inactive but powered state.

39. In combination for use in a system including a plurality of pads each operable to provide an address and commands, a plurality of vehicles, a plurality of microcontrollers each disposed in one of the vehicles, a plurality of first means each disposed in one of the vehicles and including the microcontroller in the vehicle for providing the vehicle with an address, a plurality of second means each disposed in one of the vehicles and each operative to dispose the vehicle in an inactive but powered state when the vehicle is provided with the address, a plurality of third means each disposed in one of the vehicles for measuring the period of time, after the provision of the address in the vehicle, during which the vehicle is in the inactive but powered state, a central station for transmitting addresses and commands from the pads to the vehicles, and a plurality of fourth means each disposed in one of the vehicles for de-activating the vehicle when one of the following occurs after the vehicle has become operative in the inactive out Powered state: (1) the vehicle fails to receive the address from the central station for a first period of time and (2) none of the vehicles receives a command from any of the pads for the first period of time.

40. In a combination as set forth in claim 39, a plurality of fifth means each disposed in one of the vehicles for providing a first state of illumination in the vehicle when the vehicle is in the inactive but powered state, and a plurality of sixth means each disposed in one of the vehicles for providing a second state of illumination in the vehicle when the vehicle becomes de-activated.

41. In a combination as set forth in claim 39, a plurality of fifth means each responsive in one of the vehicles to the address and commands transmitted to the vehicle from the central station as a result of the operation of one of the pads, during the operation of the vehicle in the inactive but powered state, for operating the vehicle in an active and powered state in accordance with the commands, and a plurality of sixth means each responsive to the operation of one of the vehicles in the active and powered state for providing a third state of illumination in the vehicle.

42. In a combination as set forth in claim 41, a plurality of seventh means each disposed in one of the vehicles and responsive to the reception by the vehicle of the address of the vehicle and the commands from the central station for providing a count of the time until the next reception by the vehicle of the address of the vehicle and the commands from the central station, and a plurality of eighth means each responsive in one of the vehicles to the count by the seventh means in the vehicle of a second period of time for providing the vehicle with the inactive but powered state.

43. In a combination as set forth in claim 42, the plurality of first means including a plurality of keys each constructed to be coupled to one of the vehicles to provide the address for the vehicle.

44. In combination for use in a system including a plurality of pads each operable to provide an address and commands, a vehicle, a microcontroller in the vehicle, the microcontroller having a neutral state, a plurality of first switches in the vehicle for providing the microcontroller with an address, each of the switches having open and closed states, means associated with the first switches for setting the switches to a pattern of open and closed states representative of the address of the vehicle, a second switch having open and closed states and operable in the closed state to set the microcontroller to the neutral state, and means responsive to the closure of the second switch to set the microcontroller to the neutral state and then to set the microcontroller to the address represented by the pattern of closure of the first switches.

45. In a combination as set forth in claim 44, means for providing the vehicle with an illumination when the microcontroller in the vehicle is set to the address of the vehicle.

46. In a combination as set forth in claim 45, means for providing the vehicle with an inactive but powered state when the vehicle is provided with the address, means for maintaining the vehicle in the inactive but powered state only for a first period of time if neither of the following occurs after the vehicle is provided with the inactive but powered state: (1) the vehicle is addressed by any of the pads in the first period of time and (2) one of the pads addresses any of the vehicles, and means for maintaining the vehicle with the particular illumination during the time that the vehicle is in the inactive but powered state.

47. In a combination as set forth in claim 46, means for de-activating the vehicle if one of the following occurs: the vehicle is not addressed by any of the pads during the particular period of time that the vehicle is in the inactive but powered state of the vehicle and (2) none of the pads addresses any of the vehicles during the particular period of time, and means for discontinuing the particular illumination of the vehicle when the vehicle becomes de-activated.

48. In a combination as set forth in claim 47, the illumination provided by the vehicle in the inactive but powered state constituting a first illumination, means for providing the vehicle with an active and powered state when one of the pads addresses the vehicle in the first period of time after the vehicle becomes powered but inactive, and means for providing the vehicle with a second illumination distinguishable visually from the first illumination when the vehicle is in the active and powered state.

49. In a combination as set forth in claim 48, means for providing the vehicle in the powered but inactive state after the vehicle becomes operative in the active and powered state if (a) the pad fails to address the vehicle in a second period of time or (b) the pad addresses another one of the vehicles in the second period of time.

50. In combination for use in a system including a plurality of pads each operable to provide an address and commands a vehicle, a microcontroller in the vehicle, means in the vehicle, including the microcontroller, for providing the microcontroller with an address, means responsive to the provision of the address in the microcontroller for operating the vehicle in an inactive but powered state, and means for de-activating the vehicle if neither of the following occurs while the vehicle is in the inactive but powered state: (1) the vehicle receives the address from any of the pads in a first period of time and (2) one of the pads gives a command to any of the vehicles in the first period of time.

51. In a combination as set forth in claim 50, means for providing the vehicle with an illumination during the time that the vehicle is operated in the inactive but powered state, and means for discontinuing the illumination in the vehicle when neither of the following occurs while the vehicle is in the inactive but powered state: (1) the vehicle receives the address from any of the pads in the first period of time and (2) one of the pads receives a command from any of the vehicles in the first period of time.

52. In a combination as set forth in claim 51, the illumination constituting a first illumination, means in the vehicle for receiving the address from the pad in the first period of time, and means in the vehicle for providing the vehicle with a second illumination different from the first illumination when the vehicle receives the address from the pad in the first period of time, the receiving means in the vehicle also receiving commands with the address of the vehicle from the pad, and means in the vehicle for operating the vehicle in accordance with the commands received from the pad.

53. In a combination as set forth in claim 50, means in the vehicle for receiving the address from one of the pads in the first period of time, and means in the vehicle for providing the vehicle with a second illumination different from the first illumination when the vehicle receives the address from the pad in the first period of time.

54. In a combination as set forth in claim 53, the receiving means in the vehicle also receiving commands with the address from the pad, and means in the vehicle for operating the vehicle in accordance with the commands received from the pad.

55. In a combination as set forth in claim 54, means in the vehicle for providing the vehicle in the active and powered state when the vehicle is being operated in accordance with the commands from the pad, and means in the vehicle for providing the vehicle in the powered but inactive state when neither of the following occurs while the vehicle is in the active and powered state: (a) the vehicle receives the address from the pad in a second period of time and (b) one of the pads addresses any of the vehicles in the second period of time.

56. In combination for use in a system including a plurality of pads each operable to provide an address and commands, a vehicle included in a plurality of vehicles, first means in the vehicle for providing the vehicle with an address, a key disposable in the vehicle for co-operating with the first means to provide the vehicle with the address, means responsive to the address in the vehicle upon the disposition of the key in the vehicle for operating the vehicle in an inactive but powered state, and means for de-activating the vehicle if neither of the following occurs while the vehicle is in the inactive but powered state: (1) the vehicle receives the address from any of the pads in a first period of time and (2) one of the pads provides a command to any of the vehicles in the first period of time.

57. In a combination as set forth in claim 56, means for providing the vehicle with an illumination during the time that the vehicle is operated in the inactive but powered state, and means for discontinuing the illumination in the vehicle when neither of the following occurs while the vehicle is in the inactive but powered state: (1) the vehicle receives the address from any of the pads during the first period of time and (2) one of the pads gives a command to any of the vehicles in the first period of time.

58. In a combination as set forth in claim 57, the key being disposable in the vehicle in a co-operative relationship with the vehicle for actuation in the vehicle, after the vehicle becomes de-activated, to operate the vehicle again in the inactive but powered state with the address of the vehicle.

59. In a combination as set forth in claim 55, means in the vehicle for receiving the address from one of the pads in the first period of time, and means in the vehicle for providing the vehicle with a second illumination different from the first illumination when the vehicle receives the address from the pad in the first period of time.

60. In a combination as set forth in claim 59, the receiving means in the vehicle also receiving commands with the address from the pad, and means in the vehicle for operating the vehicle in accordance with the commands received from the pad.

61. A key for activating a vehicle in accordance with the disposition of switches and contacts in the vehicle, a body, a plurality of ribs disposed on the body in a pattern providing an address to the vehicle when the key is disposed in the vehicle, the ribs being disposed to activate the switches in the vehicle, a conductive bar disposed on the body to close the contacts when the key is disposed in the vehicle, and light illuminating means disposed on the body for illuminating the key when the key is disposed in the vehicle and the switches become activated.

62. A key as set forth in claim 61, including, the conductive bar constituting a first conductive bar, and a second conductive bar disposed on the body in displaced relationship to the first conductive bar in the direction of movement of the key into the vehicle to close the contacts after the first conductive bar has closed the contacts and the contacts have thereafter been opened as a result of a de-activation of the vehicle.

63. A key as set forth in claim 61, including, contacts disposed on the body and connected to the illuminating means for providing for an illumination of the illuminating means when the key is disposed in the vehicle.

64. A key as set forth in claim 61, including, a light illuminating panel disposed in communication with the illuminating means to conduct light from the illuminating means.

65. A key as set forth in claim 59, including, the vehicle having a socket, and means disposed on the body for guiding the key into the socket in the vehicle to activate the switches in the vehicle.

66. A key as set forth in claim 65, including, the conductive bar constituting a first conductive bar, a second conductive bar disposed on the body in displaced relationship to the first conductive bar in the direction of movement of the key into the vehicle to close the contacts after the first conductive bar has closed the contacts and the contacts have thereafter been opened as a result of a de-activation of the vehicle, contacts disposed on the body and connected to the illuminating means for providing for an illumination of the illuminating means when the key is disposed in the vehicle, a light illuminating panel disposed in communication with the illuminating means to conduct light from the illuminating means.

67. In combination, a vehicle, a socket in the vehicle, a key disposable in the socket and including a body, a plurality of ribs disposed on the body of the key in a pattern providing an address to the vehicle when the key is disposed in the vehicle, a plurality of switches disposed in the vehicle for activation by the ribs when the key is disposed in the socket, a conductive bar on the body, and normally open conductive contacts disposed in the vehicle for closure by the conductive bar upon the disposition of of the key in the socket.

68. In a combination as set forth in claim 67, the key being disposable in the socket in the vehicle in a first relationship with the socket, the conductive bar constituting a first conductive bar, a second conductive bar disposed on the body in displaced relationship to the first conductive bar, the second conductive bar being disposed on the body to close the contacts upon a disposition of the key in the socket in a second relationship with the socket.

69. In a combination as set forth in claim 68, a spring disposed in the vehicle relative to the socket with the key disposed in the second relationship with the socket for returning the key to a position in the socket, after the engagement of the contacts by the second conductive bar, where the conductive bars are between the contacts.

70. In a combination as set forth in claim 69 wherein light illuminating means are disposed on the body for illuminating the key when the key is disposed in the vehicle socket and the switches become activated and wherein contacts are disposed on the body and are connected to the light illuminating means for providing for an illumination of the light illuminating means when the key is disposed in the vehicle socket.

71. In a combination as set forth in claim 70 wherein a light illuminating panel is disposed in communication with the light illuminating means to conduct light from the light illuminating means.

72. In a combination as set forth in claim,67, a microcontroller having resettable and settable states and operative initially in the reset state upon an engagement between the conductive bar and the conductive contacts in the vehicle and thereafter operative in the set state, the microcontroller being operative in the set state to set the address of the vehicle.

73. In combination for use in a system including a plurality of pads each operable to provide a plurality of individual addresses and commands with the addresses, a vehicle constructed to provide an address and to operate in a powered and active state in accordance with the reception of the address from any one of the pads and with the reception of commands from the pad, first means in the vehicle for providing an inactive but powered state in the vehicle, second means responsive in the vehicle to the reception in the vehicle of the address and the commands from any of the pads for operating the vehicle in the powered and active state in accordance with the commands, and third means for de-powering the vehicle upon the failure of the vehicle to receive the address and the commands from any of the pads within a particular period of time after the vehicle becomes operative in the powered but inactive state.

74. In combination as set forth in claim 73, an illuminable light, means in the vehicle for illuminating the light with first characteristics when the vehicle is receiving the address and commands from any one of the pads in the active and powered state, and means in the vehicle for illuminating the light with second characteristics different from the first characteristics when the vehicle is in the powered but inactive state.

75. In a combination as set forth in claim 74, means for extinguishing the light in the vehicle when the vehicle becomes de-powered.

76. In a combination for use in a system including a plurality of pads each operable to provide an address and commands with the address, a vehicle constructed to provide an address and to operate in accordance with the reception of the address and commands from any one of the pads, first means in the vehicle for operating the vehicle in an active and powered state in accordance with the reception of the address and commands from any one of the pads, second means in the vehicle for providing a powered but inactive state in the vehicle upon the failure of the vehicle to receive commands from the pad for a first particular period of time in the active and powered state, and third means in the vehicle for deactivating the vehicle upon the failure of the vehicle to receive the address and commands from any one of the pads for a second period of time after the vehicle becomes powered but inactive.

77. In a combination as set forth in claim 76, an illuminable light on the vehicle, means in the vehicle for illuminating the light on the vehicle with first characteristics when the vehicle is receiving the address and commands from the pad, and means in the vehicle for illuminating the light in the vehicle with second characteristics different from the first characteristics when the vehicle is powered but inactive.

78. In a combination as set forth in claim 77, means in the vehicle for discontinuing the illumination of the light when the vehicle is deactivated.

79. In a combination for use with a plurality of pads each constructed to provide an address and commands, a vehicle, a plurality of switches in the vehicle, each of the vehicles having open and closed states, a key insertable into the vehicle and having elements disposed in co-operative relationship with the switches, upon the insertion of the key into the vehicle, for providing an opening and closing of the switches in a pattern providing an address for the vehicle, means operative in the vehicle for receiving the address and commands from one of the pads, and means responsive in the vehicle to the reception of the address and commands from the pad for operating the vehicle in accordance with the commands from the pad.

80. In a combination as set forth in claim 79, a microcontroller in the vehicle, the microcontroller having settable and resettable states and being operable in the set state for setting the address of the vehicle, and means disposed on the vehicle and the key in a co-operative relationship upon the insertion of the key into the vehicle for providing initially for a resetting of the microcontroller and subsequently for a setting of the microcontroller.

81. In a combination as set forth in claim 79, at least one element on the key for guiding the insertion of the key into the vehicle.

82. In a vehicle as set forth in claim 79, the vehicle having an active and powered state during the reception by the vehicle of the address and the commands from the pad, having an inactive but powered state to provide for the reception by the vehicle of the address and commands from any of the pads and having a de-activated state, and means for initially setting the vehicle to the inactive but powered state upon the insertion of the key into the vehicle.

83. In a combination as set forth in claim 82, a microcontroller in the vehicle, the microcontroller having settable and resettable states and being operative in the set state for controlling the address of the vehicle, and means disposed on the vehicle and the key in a co-operative relationship upon the insertion of the key into the vehicle for providing initially for a resetting of the microcontroller and subsequently for a setting of the microcontroller.

84. In a combination as set forth in claim 83, means disposed on the vehicle and the key and responsive to a further insertion of the key into the vehicle upon the de-activation of the vehicle for providing initially for a resetting of the microcontroller and subsequently for a setting of the microcontroller.

85. In a combination in a system including a plurality of pads each operable to provide an address and commands, a key, a vehicle constructed to receive the key, a plurality of switches disposed in the vehicle, each of the switches having open and closed states of operation and being normally in the open state of operation, the key being insertable into the vehicle and being constructed to activate switches in the plurality to the closed state in a pattern providing an address of the vehicle, the vehicle having an active and powered state, an inactive but powered state and a de-activated state, the vehicle being responsive in the active and powered state to the address and commands from one of the pads and being responsive in the inactive but powered state to the address and commands from any of the pads, a microcontroller responsive in the vehicle to the insertion of the key into the vehicle for providing for an operation of the vehicle in the inactive but powered state, and means responsive in the vehicle to the address transmitted to the vehicle from one of the pads for changing the operation of the vehicle from the inactive but powered state to the active and powered state for a subsequent response of the vehicle to the address and commands of the pad.

86. In a combination as set forth in claim 85, means disposed on the vehicle and the key in a co-operative relationship and responsive to the de-activation of the vehicle and to a further insertion of the key into the vehicle for providing for an operation of the vehicle in the inactive but powered state.

87. In a combination as set forth in claim 85, the microcontroller having resettable and settable states and being responsive to the operation of the vehicle in the inactive but powered state upon the insertion of the key into the vehicle for initially providing for the operation of the vehicle in the reset state and for subsequently providing for the operation of the vehicle in the set state, the vehicle being operative in the set state to provide the address of the vehicle.

* * * * *

UNITED STATES PATENT AND TRADEMARK OFFICE

CERTIFICATE OF CORRECTION

PATENT NO. : 5,888,135

DATED : Mar. 30, 1999

INVENTOR(S) : William M. Barton, Peter C. DeAngelis, Paul Eichen

It is certified that error appears in the above-identified patent and that said Letters Patent is hereby corrected as shown below:

Title page, under U.S. PATENT DOCUMENTS, add the following:

| | | |
|---|---|---|
| --4,334,221 | 6/1982 | Rosenhagen et al. |
| 5,135,427 | 8/1992 | Suto, et al. |
| 5,435,553 | 7/1995 | Arima et al. |
| 5,364,108 | 11/1994 | Esnouf |
| 5,435,768 | 7/1995 | Dunleavy |
| 3,596,400 | 8/1971 | Cheng |
| 5,474,486 | 12/1995 | Chilton et al. |
| 5,073,750 | 12/1991 | Coron |
| 4,213,270 | 7/1980 | Oda |
| 4,226,292 | 10/1980 | Monte et al. |
| 4,197,672 | 4/1980 | Mabuchi et al. |
| 3,303,821 | 2/1967 | Harris |
| 5,429,543 | 7/1995 | Tilbor et al. |
| 3,926,434 | 12/1975 | Cannon, Jr. |
| 5,471,668 | 11/1995 | Soenen et al. |
| 5,148,159 | 9/1992 | Clark et al. |
| 4,563,626 | 1/1986 | Ohtake |
| 4,817,948 | 4/1989 | Simonelli |
| 5,452,901 | 9/1995 | Nakada et al. |
| 5,098,110 | 3/1992 | Yang |
| 3,400,488 | 9/1968 | Phillpott et al. |
| 3,482,046 | 12/1969 | Hughson et al. |
| 3,639,755 | 2/1972 | Wrege |
| 3,782,031 | 1/1974 | Byron |
| 4,080,602 | 3/1978 | Hattori et al. |
| 4,135,181 | 1/1979 | Bogacki et al. |
| 4,171,468 | 10/1979 | Reiner |
| 4,087,799 | 5/1978 | Brouwer |
| 4,141,553 | 2/1979 | Beny et al.-- |

UNITED STATES PATENT AND TRADEMARK OFFICE

CERTIFICATE OF CORRECTION

PATENT NO. : 5,888,159

DATED : Mar. 30, 1999

INVENTOR(S) : William M. Barton, Peter C. DeAngelis, Paul Eichen

It is certified that error appears in the above-identified patent and that said Letters Patent is hereby corrected as shown below:

Column 6, line 19, after "12", add --to--.

Column 20, claim 20, line 39, after "member", add --,--.

Column 24, claim 39, line 8, change "P", to --p--.

Column 25, claim 50, line 49, after "commands", add --,--.

Column 28, claim 67, line 21, delete "of", 2nd occurence.

Signed and Sealed this

Second Day of November, 1999

*Attest:*

*Attesting Officer*

Q. TODD DICKINSON

*Acting Commissioner of Patents and Trademarks*